US010343039B2

(12) United States Patent
Davis et al.

(10) Patent No.: US 10,343,039 B2
(45) **Date of Patent: *Jul. 9, 2019**

(54) LIGHTWEIGHT MULTICOLOR COMPRESSION MOLDED GRIP

(71) Applicant: EATON INTELLIGENT POWER LIMITED, Dublin (IE)

(72) Inventors: Stephen James Davis, Pinehurst, NC (US); Alex Lee Walls, Laurinburg, NC (US); Wen-Chen Su, Pinehurst, NC (US); Aaron Joseph Michaud, Fuquay-Varina, NC (US); Edward Wang, Tainan (TW)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/010,557

(22) Filed: Jun. 18, 2018

(65) Prior Publication Data

US 2018/0296891 A1 Oct. 18, 2018

Related U.S. Application Data

(62) Division of application No. 14/964,384, filed on Dec. 9, 2015, now Pat. No. 9,999,815.

(51) Int. Cl.
*A63B 53/14* (2015.01)
*A63B 60/08* (2015.01)
(Continued)

(52) U.S. Cl.
CPC ..... *A63B 53/14* (2013.01); *A63B 60/08* (2015.10); *A63B 60/14* (2015.10); *A63B 2071/0694* (2013.01)

(58) Field of Classification Search
CPC ..... A63B 53/14; A63B 60/08; A63B 60/14; A63B 2071/0694
See application file for complete search history.

(56) References Cited

U.S. PATENT DOCUMENTS

| | | | |
|---|---|---|---|
| 979,266 | A | 12/1910 | Dean |
| 5,681,226 | A | 10/1997 | Chambers, Jr. |
| 6,093,767 | A | 7/2000 | Davis |
| 6,184,290 | B1 | 2/2001 | Ahmed et al. |

(Continued)

FOREIGN PATENT DOCUMENTS

GB 1356971 A 6/1974

OTHER PUBLICATIONS

Jun. 5, 2017, UK Patents Act 1977: Search Report under Section 17(5), Application No. GB1620728.4; 158 pages.

(Continued)

*Primary Examiner* — Stephen L Blau
(74) *Attorney, Agent, or Firm* — Dawsey Co., LPA; David J. Dawsey

(57) ABSTRACT

A lightweight compression molded multicolor golf grip having at least a first section and a second section of differing colors and composed of elastomer compounds having a density of less than 0.90 g/cc, and joined by cross-linking across a sharply defined cross-color interface having an interface transition zone beyond which there is no mixing of the colors. The grip has a soft feel and unique compression characteristics achieved in some embodiments through the controlled use of an expanding blowing agent in a rubber compound including an EPDM mixture. Achieving the sharply defined cross-color interface is due in part to the use of complementary geometries at opposing interface edges to increase the stability of the interface and reduce the flow during molding associated with the increased viscosity of low density rubber compounds, promote cross-linking of the sections, and better distribute and control the consolidation pressure.

20 Claims, 22 Drawing Sheets

(51) Int. Cl.
*A63B 60/14* (2015.01)
*A63B 71/06* (2006.01)

(56) References Cited

U.S. PATENT DOCUMENTS

| | | | |
|---|---|---|---|
| 6,843,732 | B1 | 1/2005 | Huang |
| 7,008,582 | B2 | 3/2006 | Chen |
| 7,015,284 | B2 | 3/2006 | Ajbani |
| 7,264,759 | B2 | 9/2007 | Lamkin |
| 7,319,121 | B2 | 1/2008 | Jacob |
| 7,458,903 | B2 | 12/2008 | Wang |
| D584,781 | S | 1/2009 | Chen |
| 7,566,375 | B2 | 7/2009 | Huang |
| 7,749,094 | B2 | 7/2010 | Chen |
| 7,947,206 | B2 | 5/2011 | Chen |
| 7,963,857 | B1 | 6/2011 | Kachlik |
| 8,288,470 | B2 | 10/2012 | Ansems et al. |
| 8,334,337 | B2 | 12/2012 | Lamkin et al. |
| 8,360,898 | B2 | 1/2013 | Huang |
| 8,371,956 | B2 | 2/2013 | Walls |
| 8,389,634 | B2 | 3/2013 | Yalvac et al. |
| D696,368 | S | 12/2013 | Huang |
| 8,617,664 | B2 | 12/2013 | Huang |
| 8,647,462 | B2 | 2/2014 | Su et al. |
| 9,233,284 | B2 | 1/2016 | Nathan |
| 2002/0187845 | A1 | 12/2002 | Kim |
| 2005/0148401 | A1 | 7/2005 | Huang |
| 2005/0170905 | A1 | 8/2005 | Chen |
| 2006/0089071 | A1 | 4/2006 | Leidig et al. |
| 2006/0287123 | A1 | 12/2006 | Wang |
| 2008/0039225 | A1 | 2/2008 | Chen |
| 2008/0125238 | A1 | 5/2008 | Chen |
| 2008/0176969 | A1 | 7/2008 | Tahri |
| 2008/0312005 | A1 | 12/2008 | Hung |
| 2009/0174116 | A1 | 7/2009 | Gill et al. |
| 2010/0136273 | A1 | 6/2010 | Prieto et al. |
| 2010/0190569 | A1 | 7/2010 | Chen et al. |
| 2012/0065314 | A1 | 3/2012 | Lamkin et al. |
| 2012/0252917 | A1 | 10/2012 | Kisin et al. |
| 2013/0079174 | A1 | 3/2013 | Gill et al. |
| 2014/0076487 | A1 | 3/2014 | Su et al. |
| 2014/0206471 | A1 | 7/2014 | Jertson |
| 2015/0025165 | A1 | 1/2015 | Chen et al. |
| 2016/0107052 | A1 | 4/2016 | Wang et al. |

OTHER PUBLICATIONS

Golf Pride, Dec. 1, 2015, "MCC grip", americangolf.co.uk [online], Available from: http://www.americangolf.co.uk/balls-accessories/grips/golf-pride-mcc-plus4-grip-281776.html [Accessed Jun. 2, 2017].

| Depth (in) | Compression(N) Grip A |
|---|---|
| 0.01 | 2 |
| 0.02 | 3 |
| 0.03 | 4.5 |
| 0.04 | 7 |
| 0.05 | 12 |
| 0.06 | 18 |

LIGHTWEIGHT MULTICOLOR COMPRESSION MOLDED GRIP

CROSS-REFERENCE TO RELATED APPLICATIONS

This application is a divisional application of U.S. non-provisional application Ser. No. 14/964,384, filed on Dec. 9, 2015, all of which is incorporated by reference as if completely written herein.

STATEMENT REGARDING FEDERALLY SPONSORED RESEARCH OR DEVELOPMENT

This invention was not made as part of a federally sponsored research or development project.

TECHNICAL FIELD

The present disclosure relates generally to grips and, more particularly, to hand grips for sporting implements.

BACKGROUND OF THE INVENTION

There are many different types of grips used today for a wide variety of items, including without limitation, golf clubs, tools (hammer handles, screwdrivers, etc.), racquets (racquet ball, squash, badminton, or tennis racquets), bats (baseball or softball), pool cues, umbrellas, fishing rods, etc. While particular reference for this disclosure is being made to the application of golf club grips, it should be immediately apparent that the present disclosure is applicable to other grips as well.

Slip-on golf club grips made of a molded rubber material or synthetic polymeric materials are well known and widely used in the golf industry. The term "slip-on" as employed herein refers to a grip that slides on to a shaft or handle and is secured by way of an adhesive, tape, or the like. Slip-on grips are available in many designs, shapes, and forms.

Golf club grips historically have been made of a wide variety of materials such as leather wrapped directly on the handle or leather wrapped on sleeves or underlistings that are slipped on to the handle, or more recently rubber, polyurethane or other synthetic materials are used. Up until now, various construction methods have been used to produce a lower overall material density. Most commonly, an inner structure is formed using a light weight foam material, often EVA foam. Over this structure, a gripping layer is located and held in place through the use of either an adhesive or some other bonding method. Most commonly, this gripping layer is made from a felt material where the outside is coated in polyurethane to provide a smoother and more durable outer layer. Another existing method of manufacturing a lightweight structure to form a grip is to use expanded foam/sponge material tubes (EVA, nitrile rubber, etc.) molded, or ground, to shape. These foam/sponges also have relatively low abrasion and UV resistance, tend to wear out more quickly than traditional rubber grips, and may take on a permanent compression set over time leaving permanent depressions in the golf grip, thereby risking a potential violation of the rules of golf.

There is a trend in golf toward lighter weight. Swing grips, as used on clubs such as woods and irons, that are light weight offer the golfer enhanced performance by generally facilitating a faster club head speed. Further, there is a trend in non-swing grips, or putter grips, to oversized grips that provide a more stable grip and help prevent the wrists from becoming too active during a putting stroke. While the size of such grips increases, it is desirable to maintain the weight of the grip consistent with non-oversized grips so the balance and swing weight of the putter is maintained.

It is also desirable to offer golf grips in multiple colors. A multiple color grip is more attractive and gives the brand an identity for instant brand recognition. When molding a golf grip in multiple colors it is desirable to form a defined border between the colors that is consistent in location and shape. The defined border may be a straight line, an angled line, a curved line, or any desired geometry. The defined border between colors increases the perceived product quality and brand identity. However, this is difficult to achieve such a defined border with light weight rubber molding because the materials are not stable at the lower densities needed to achieve the desired grip weight.

It is desirable to produce lightweight multicolor compression molded grips using rubber compounds. Rubber has a good feel and is preferred by golfers. However, rubber is a heavy material with a density of approximately 1.2 g/cc. In order to reduce the density, lightweight materials must be added to the rubber compound, which further increase the difficulty of achieving a defined border. Thus, there still exists a need for a lightweight multicolor compression molded grip having a sharply defined interface between the colors, particularly one that is soft, resilient, and resistant to permanent deformation and the associated risks.

SUMMARY OF THE INVENTION

A lightweight compression molded multicolor golf grip having at least a first section and a second section of differing colors and composed of elastomer compounds having a density of less than 0.90 g/cc, and joined by cross-linking across a sharply defined cross-color interface having an interface transition zone beyond which there is no mixing of the colors. The grip has a soft feel and unique compression characteristics achieved in some embodiments through the controlled use of an expanding blowing agent in a rubber compound including an EPDM mixture. Achieving the sharply defined cross-color interface is due in part to the use of complementary geometries at opposing interface edges to increase the stability of the interface and reduce the flow during molding associated with the increased viscosity of low density rubber compounds, promote cross-linking of the sections, and better distribute and control the consolidation pressure. Traditionally compression molded elastomer compound grips feel hard or firm, which is undesirable in some grips, such as a putter grip. The best feedback for a golfer regarding grip pressure is to provide a grip with a relatively consistent and a relatively flat compressive force to compression depth line so that a golfer's grip never gets to the point of strongly squeezing the grip without sensing additional deflection. Likewise, consistency of a ratio of the compressive force to the compression depth throughout a range of compression depths, while still providing the necessary resiliency, provides improved feedback.

BRIEF DESCRIPTION OF THE DRAWINGS

Without limiting the scope of the present invention as claimed below and referring now to the drawings and figures:

Figure 1:
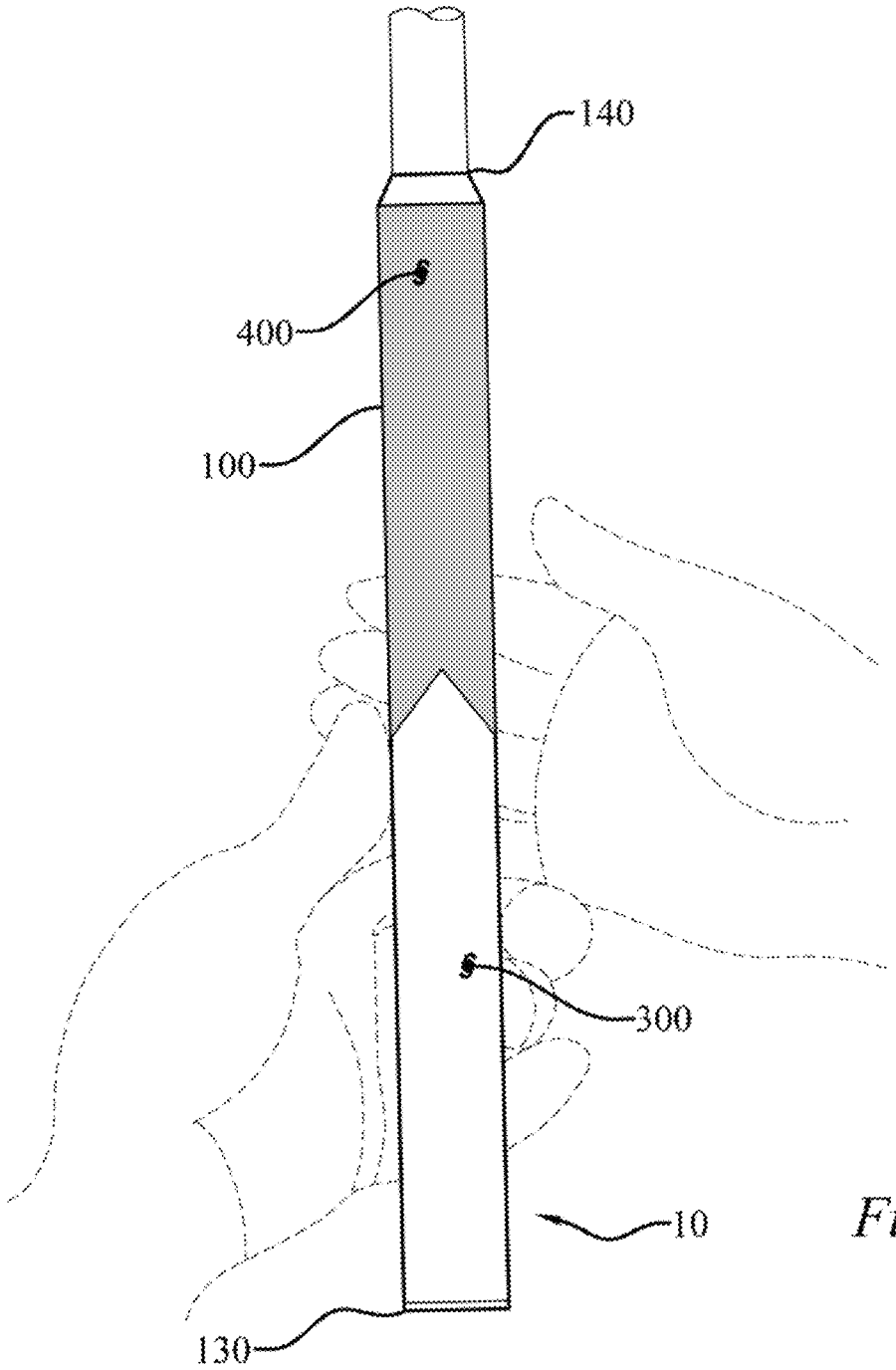
FIG. 1 shows a top view of an embodiment of the golf grip, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The present invention enables a significant advance in the state of the art. The preferred embodiments of the invention accomplish this by new and novel arrangements of elements, materials, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. Broken lines illustrate optional features or operations unless specified otherwise. All publications, patent applications, patents, and other references mentioned herein are incorporated herein by reference in their entireties. Even though the embodiments of this disclosure are particularly suited as golf club grips and reference is made specifically thereto, it should be immediately apparent that embodiments of the present disclosure are applicable to other grips for implements other than golf clubs.

Figure 2:
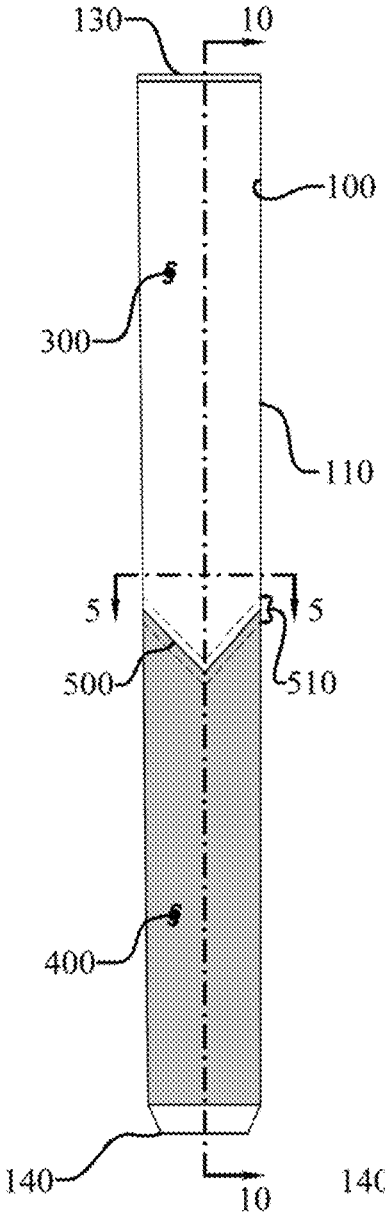
FIG. 2 shows a front elevation view of an embodiment of the golf grip, not to scale.
Figure 3:
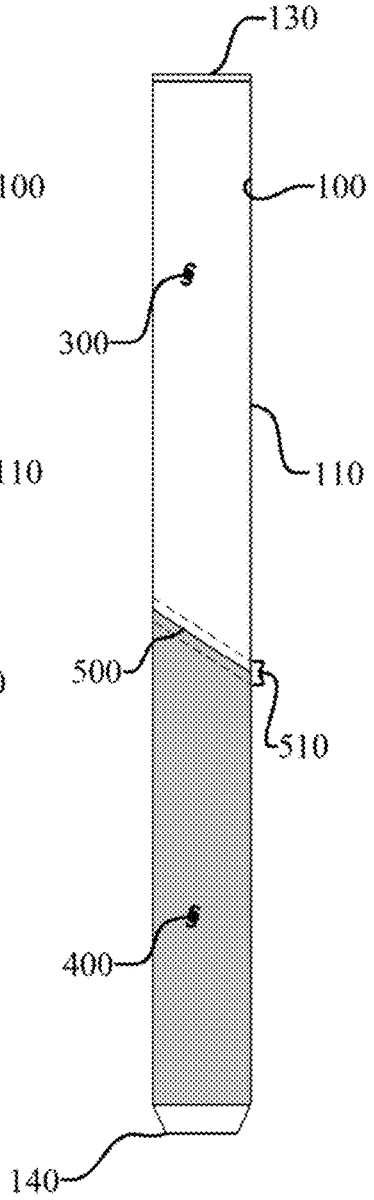
FIG. 3 shows a side elevation view of an embodiment of the golf grip, not to scale.
Figure 4:
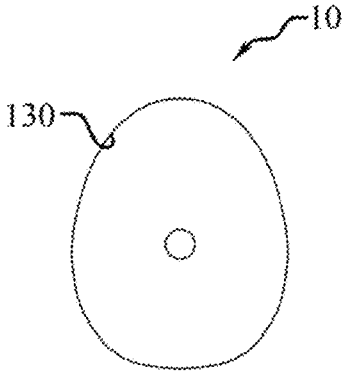
FIG. 4 shows a top plan view of an embodiment of the golf grip, not to scale.

Referring to FIG. 1, a golf grip (10) is situated in the open hands of a right-handed golfer in a traditional gripping manner. The term "right-handed" as employed herein is intended to mean someone who uses their right hand as their primary or dominant hand of choice in activities which include but are not limited to the hand they use for throwing a ball, writing, swinging a racket, a bat, or a golf club. The term "left-handed" as used herein would mean the opposite hand in these types of activities. As seen in FIGS. 2 and 3, the golf grip (10) has a structure which includes a hollow tubular body (100) with an exterior surface (110), an interior surface (120), a butt end (130), and a tip end (140). In the traditional gripping fashion of FIG. 1 an open left hand of a golfer is positioned towards the butt end (130) of the grip (10), and an open right hand is positioned towards the tip end (140), or open end, of the grip (10). In this gripping manner a couple of fingers may interlock when forming the closed grip on the golf grip (10), however one skilled in the art will appreciate that other nontraditional gripping methods such as a cross-handed grip, claw grip, saw grip, and pencil grip, just to name a few, may be utilized. Of course, each individual and the best hand position will vary with the golfer based on these and on a wide variety of golfing conditions such as weather and the golf course. Other factors include but are not limited to grip feel, golf club, shaft composition, weight of the club head, and even the size of the hands of the golfer. Naturally, for a left-handed person the placement of the hands is generally opposite that of a right-handed person. Hand placement on a golf grip is an important factor in a golf swing, whether it is a full swing or a putting stroke. Hand placement can influence the distance and direction of the travel of the golf ball.

Figure 19:
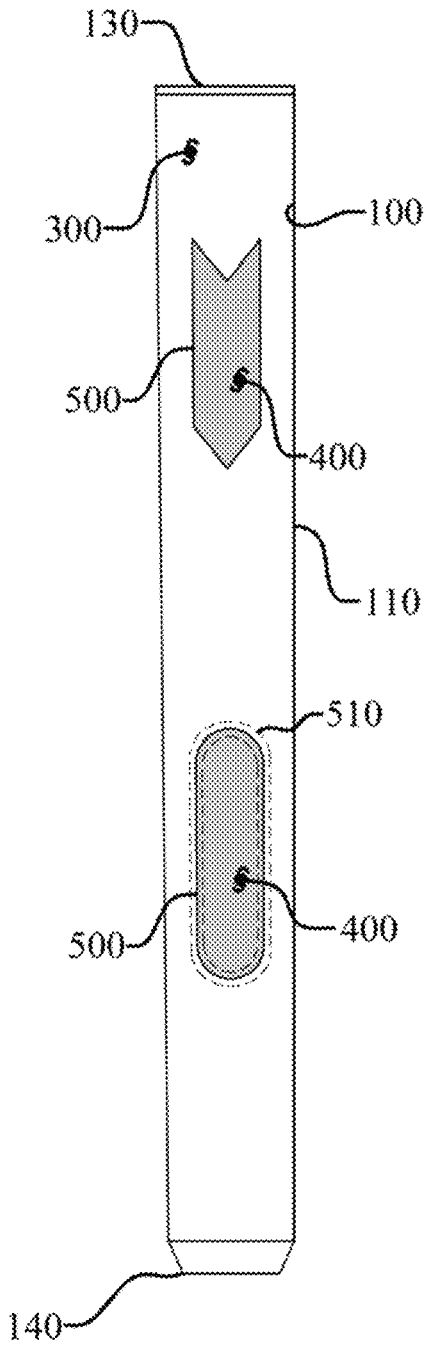
FIG. 19 shows a front elevation view of an embodiment of the golf grip, not to scale.
Figure 20:
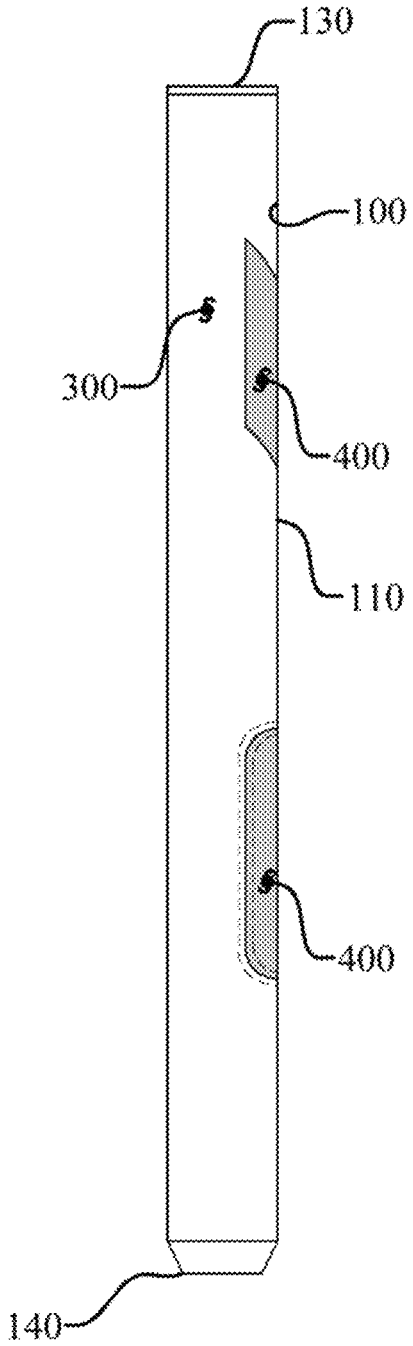
FIG. 20 shows a side elevation view of an embodiment of the golf grip, not to scale.
Figure 25:
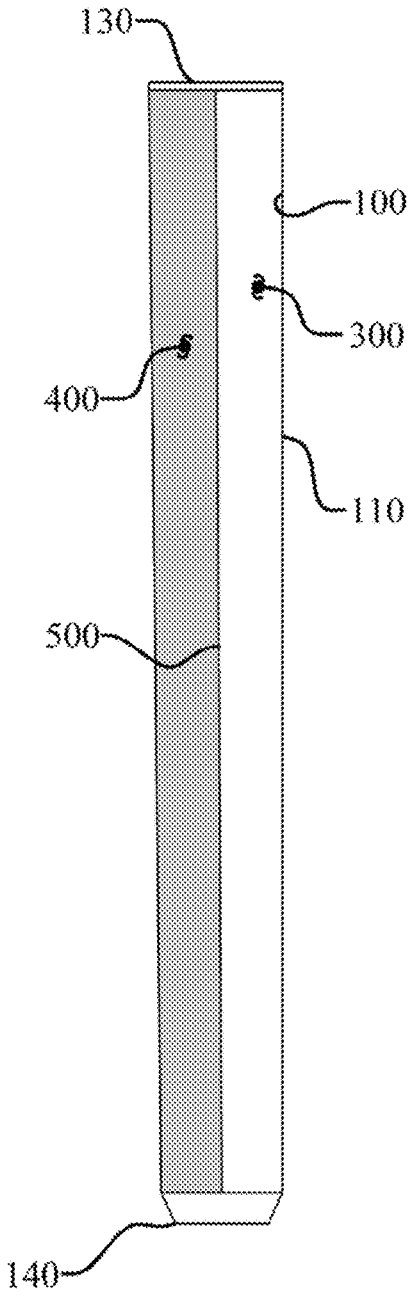
FIG. 25 shows a front elevation view of an embodiment of the golf grip, not to scale.
Figure 26:
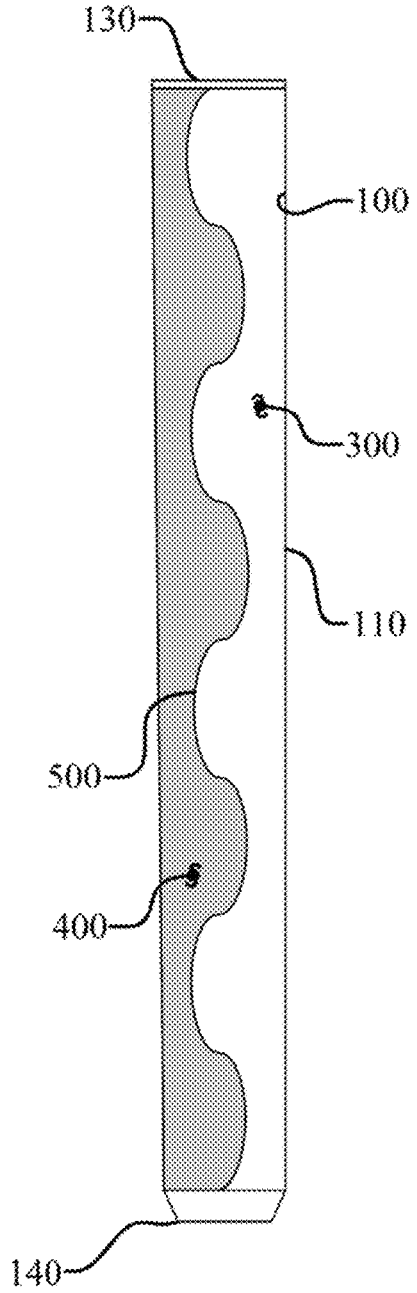
FIG. 26 shows a front elevation view of an embodiment of the golf grip, not to scale.
Figure 27:
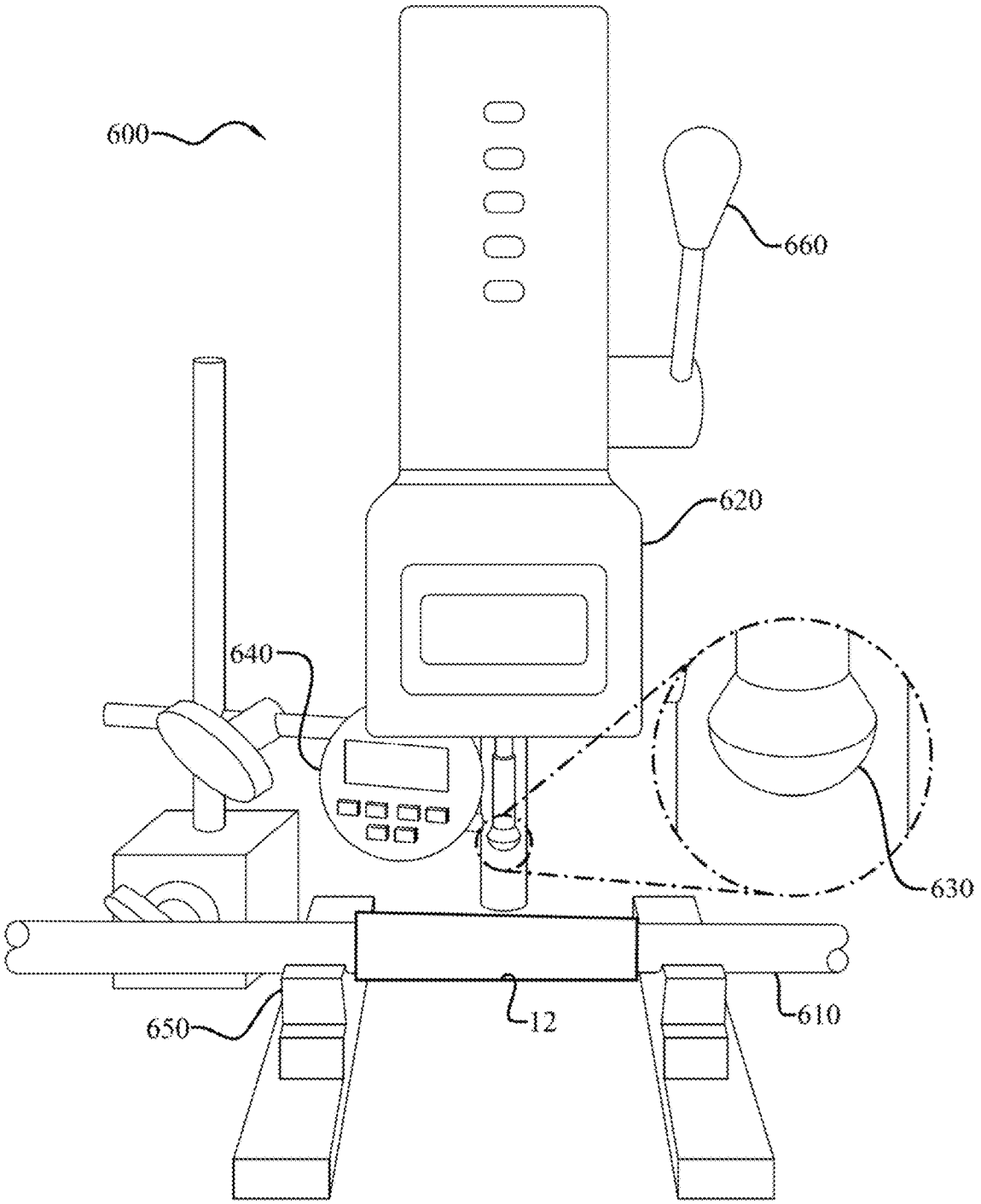
FIG. 27 shows a test station, not to scale.

The golf grip (10) is composed of at least two compression molded sections of differing color, namely a first section (300) and a second section (400) joined along a cross-color interface (500), to produce an overall density of the golf grip (10) that is less than 0.90 g/cc. The first section (300) and second section (400) may be configured adjacent to one another in any number of manners including, but not limited to, transversely dividing the golf grip (10), as seen in FIG. 2, longitudinally dividing the golf grip (10), as seen in FIGS. 25 and 26, a section may be inset and at least partially surrounded by the other section, as seen in FIGS. 19 and 20, or combinations thereof.

The first section (300) and second section (400) are formed of elastomer compounds, or long-chain polymers, which are capable of cross-linking, which is referred to as vulcanization, across the cross-color interface (500) during compression molding. The vulcanization process cross-links the polymer chains via chemical bonds creating the elastic properties. Elastomer compounds are typically described by type or family based on the base polymer used in the formulation. The first and second sections (300, 400) may be formed of compounds including acrylonitrile-butadiene rubber, hydrogenated acrylonitrilebutadiene rubber, ethylene propylene diene rubber, fluorocarbon rubber, chloroprene rubber, silicone rubber, fluorosilicone rubber, polyacrylate rubber, ethylene acrylic rubber, styrene-butadiene rubber, polyester urethane/polyether urethane, and/or natural rubber, and combinations thereof. In one embodiment the first and second sections (300, 400) are rubber compounds of either ethylene propylene diene monomer (EPDM) or a natural rubber and EPDM mixture. In one embodiment the first and second sections (300, 400) have a high ethylene content, a high molecular weight, and a very high diene ratio EPDM for cross-linking.

In order to produce an overall density of the golf grip (10) that is less than 0.90 g/cc, in one embodiment a compression molding process is used; in part because generally injection molding of rubber based compounds cannot achieve densities less than 0.96 g/cc. With compression molding, a blowing agent is mixed into the elastomer compound and is calendered into a sheet of a desired thickness. For example, the schematic process of FIGS. 13 and 14 begins with first section stock (320) and second section stock (420), which are the calendered sheets of elastomer compound containing a quantity of blowing agent. In this embodiment the first section stock (320) and second section stock (420) are then cut to form a first section top preform (330), a first section bottom preform (340), a second section top preform (430), and a second section bottom preform (440), although four preforms are not required. At least one of the calendered sheets contains a pigment or tint so that they are not the same color, leading to preform sections that are not the same color, and thus first and second section (300,400) that are not the same color.

Figure 13:
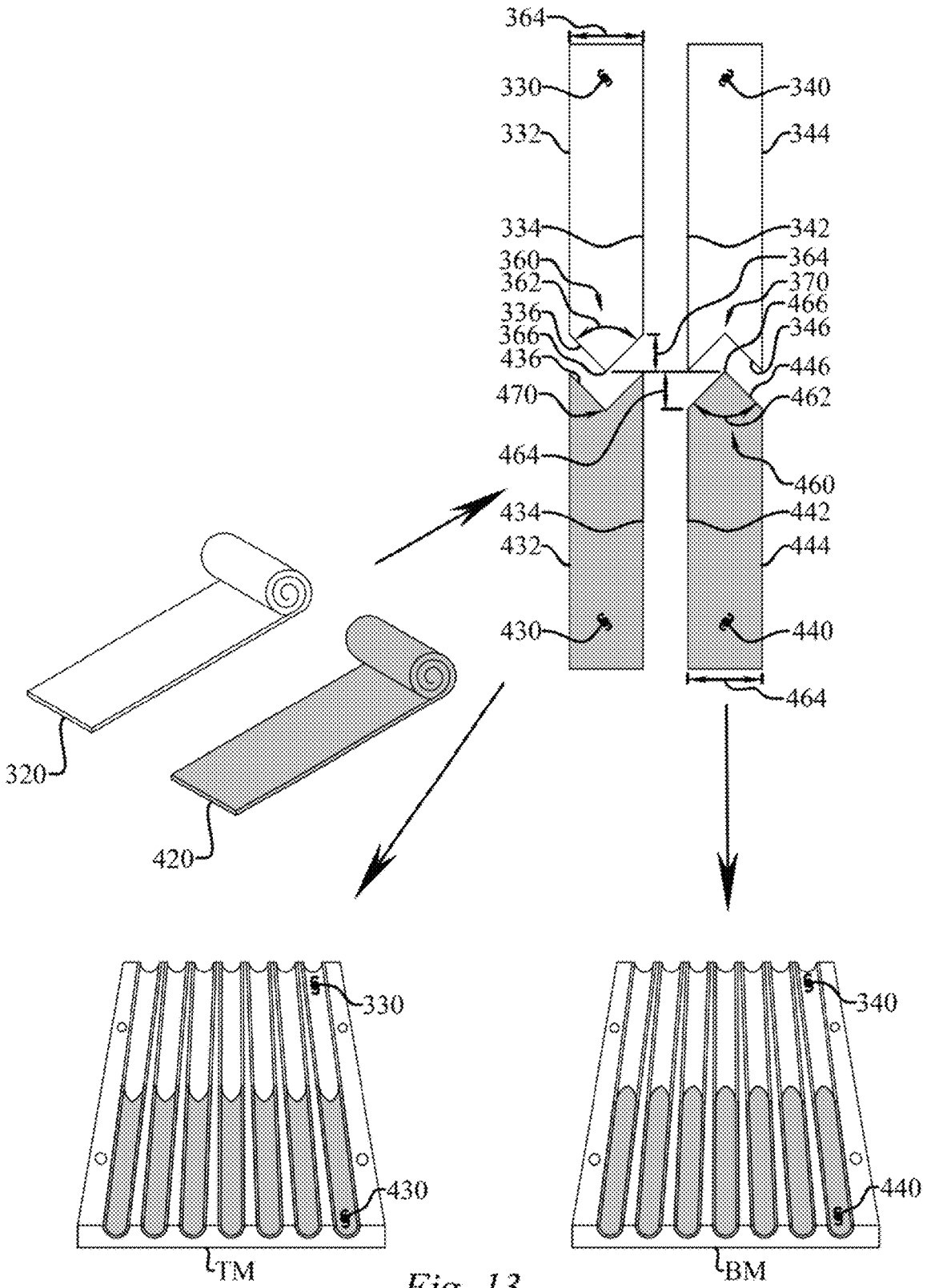
FIG. 13 shows a partial schematic view of an embodiment of a manufacturing process of an embodiment of the golf grip, not to scale.
Figure 14:
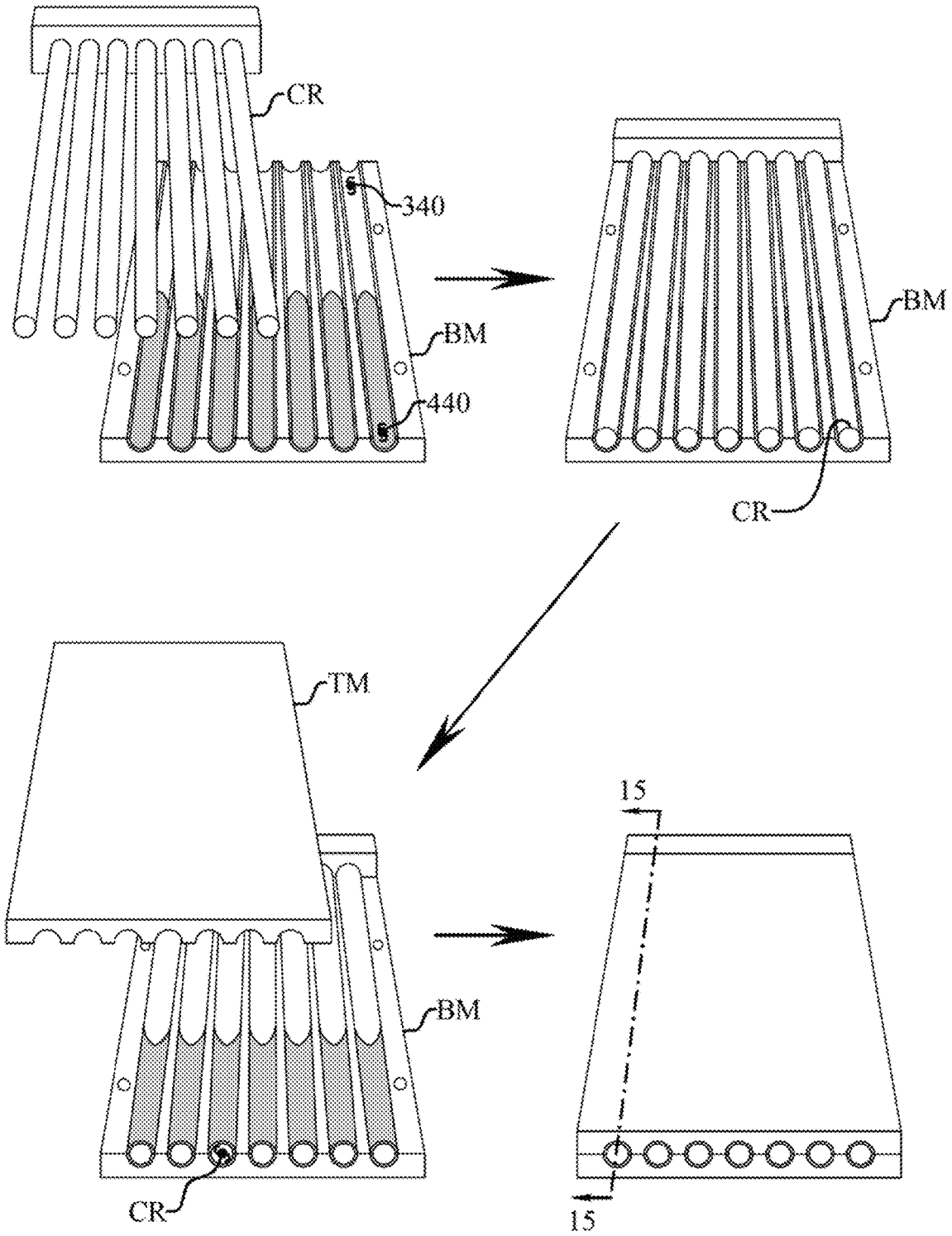
FIG. 14 shows a partial schematic view of an embodiment of a manufacturing process of an embodiment of the golf grip, not to scale.
Figure 15:
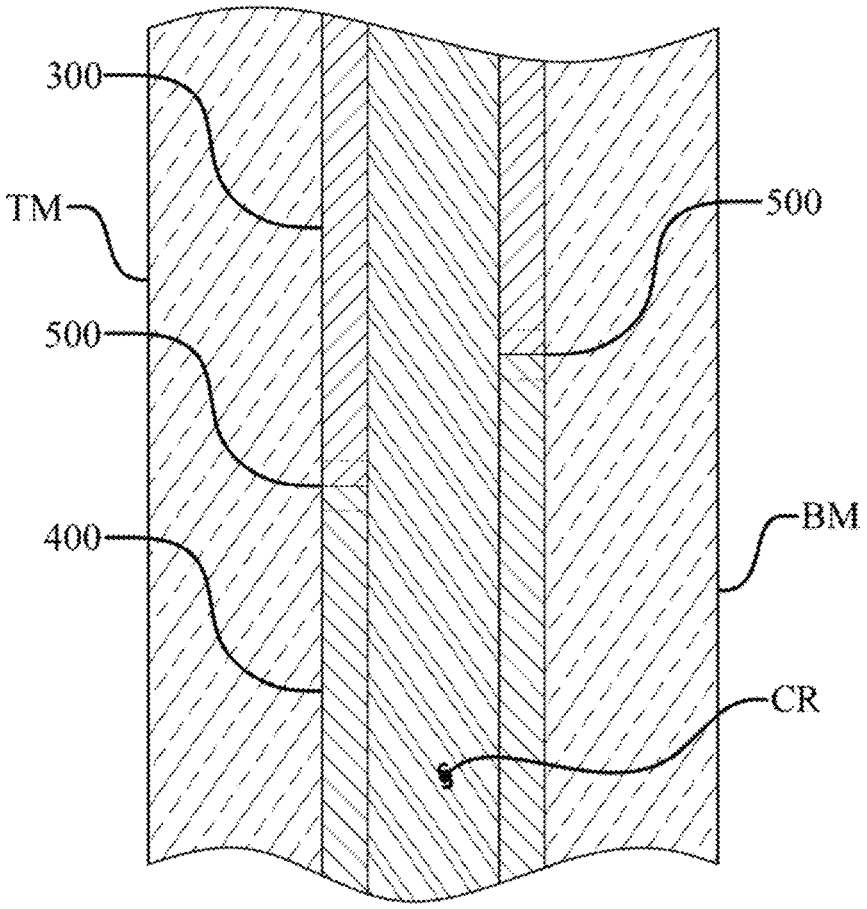
FIG. 15 shows a partial longitudinal cross-section, taken along section line 15-15 in FIG. 14, of an embodiment of some of the components of a golf grip within a mold, not to scale.
Figure 16:
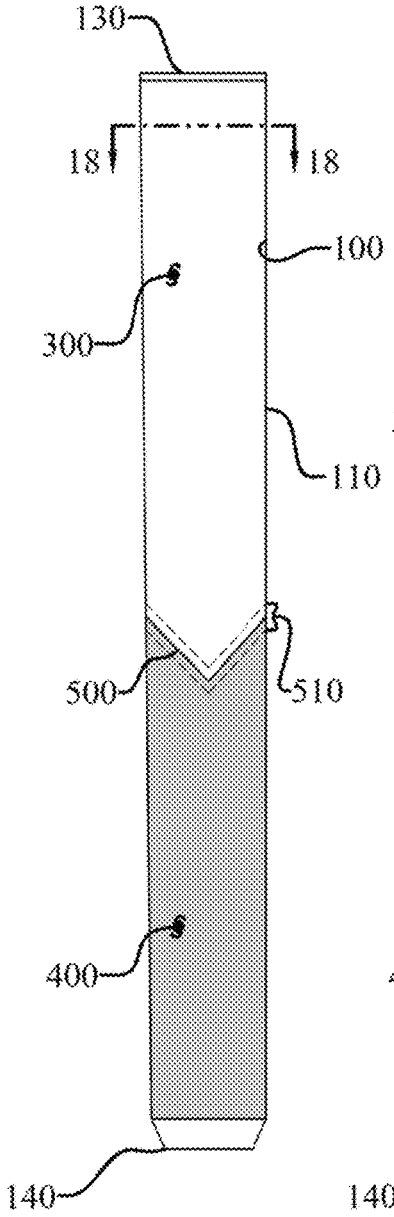
FIG. 16 shows a front elevation view of an embodiment of the golf grip, not to scale.

As seen in FIG. 13, in this embodiment the first section top preform (330) has a first section top preform sinistral edge (332), a first section top preform dextral edge (334), and a first section top preform interface edge (336); likewise, the first section bottom preform (340) has a first section bottom preform sinistral edge (342), a first section bottom preform dextral edge (344), and a first section bottom preform interface edge (346). Further, in this embodiment the second section top preform (430) has a second section top preform sinistral edge (432), a second section top preform dextral edge (434), and a second section top preform interface edge (436); likewise, the second section bottom preform (440) has a second section bottom preform sinistral edge (442), a second section bottom preform dextral edge (444), and a second section bottom preform interface edge (446). The first section bottom preform (340) and the second section bottom preform (440) are then placed in a bottom mold (BM) with the interface edges (346, 446) adjacent or abutting, followed by the placement of a core rod (CR) and placement of the first section top preform (330) and the second section top preform (430) over the core rod (CR), as seen in FIG. 14, or alternatively within a top mold (TM), as seen in FIG. 13, with the interface edges (336, 436) adjacent or abutting. In this embodiment the first section sinistral edges (332, 342) are also adjacent or abutting, as are the first section dextral edges (334, 344), the second section sinistral edges (432, 442), and the second section dextral edges (434, 444). Heat and pressure are applied to the top and bottom molds (TM, BM), and in some embodiments the core rod (CR) is heated, thereby producing cross-linking across the interface edges (346, 446), and creating the cross-color interface (500), as well as across the sinistral edges (332, 342, 432, 442) and dextral edges (334, 344, 434, 444). Again, the example of FIGS. 13 and 14 is just one embodiment and the first section (300) and second section (400) may be configured adjacent to one another in any number of manners including, but not limited to, transversely dividing the golf grip (10), as seen in FIG. 2, longitudinally dividing the golf grip (10), as seen in FIGS. 25 and 26, a section may be inset and at least partially surrounded by the other section, as seen in FIGS. 19 and 20, or combinations thereof, which means some embodiments may not have sinistral edges (332, 342, 432, 442) and/or dextral edges (334, 344, 434, 444).

Figure 17:
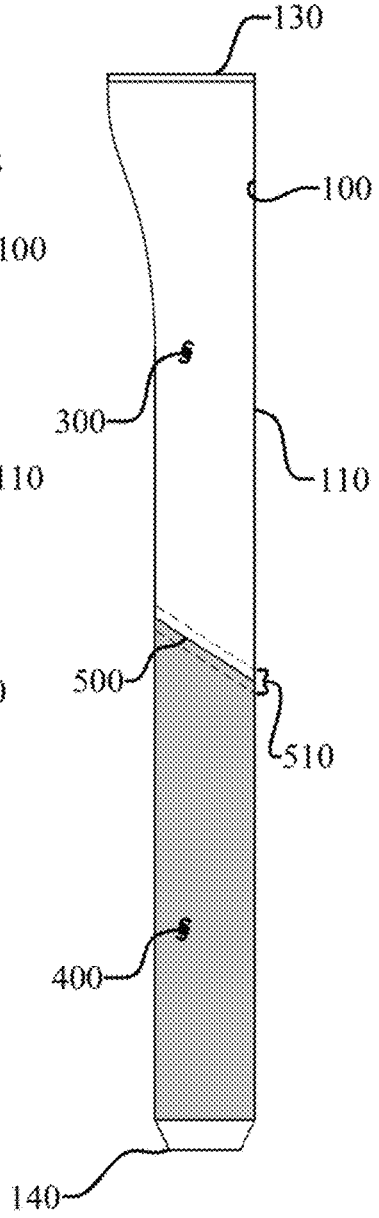
FIG. 17 shows a side elevation view of an embodiment of the golf grip, not to scale.

Achieving a sharply defined cross-color interface (500) along the intersection of the differing colors of the first section (300) and the second section (400) is difficult, particularly when the density of each preform is less than 0.90 g/cc to achieve an overall golf grip (10) density of less than 0.90 g/cc, which is further compounded in oversized embodiments of the golf grip (10) having an asymmetric transverse cross-section (i.e. one not having a round cross-section), which may also be contoured along the length in further embodiments, as seen in FIG. 17. One reason for such difficulty is associated with the blowing agent that is needed in the elastomer compound to achieve the low density.

One embodiment incorporates expanding blowing agent for expanding the compositions, which may include, but are not limited to, dinitrosopentamethylenetetramine (DPT), azodicarbonamide (AZC), p-toluenesulfonyl hydrazide (TSH), 4,4'-oxybisbenzenesulfonyl hydrazide (OBSH), and the like, and inorganic foaming agents, such as sodium hydrogen carbonate. Further, the blowing agent may include di-azo compounds which release N2 gas at high temperature, N2 gas introduced during the foaming process, CO2 from decompose chemical foaming agents, and/or expand-cell system having core-shells containing vaporization liquid inside, often referred to as expandable microspheres or microcapsules. The quantity of blowing agent is measure in parts per hundred rubber (phr).

The primary reason that compression molding is able to achieve a lighter weight than injection molding is because the quantity of blowing agent within the preforms may be higher in a compression molding process compared to an injection molding process because the blowing agent, particularly when in expanding blowing agent form, is not damaged during the compression molding process, unlike injection molding. However, expanding blowing agents introduce new complications to the compression molding process that make it difficult to achieve a sharply defined cross-color interface (500); namely, expanding blowing agents reduce the shear in the elastomer compound and lower the viscosity. This is because expanding blowing agents generally have a low friction surface. A lower viscosity elastomer compound is difficult to compression mold because the preforms may shift during the molding process due to the reduced viscosity and/or the expansion caused by the expanding blowing agent, and the interface between the sections (300, 400) may be compromised, structurally and/or aesthetically, by high quantities of expanding blowing agent causing increased instability at the interface. All of these difficulties are further heightened when producing a soft low-density multicolor compression molded grip, particularly when it is an oversized grip with may have an asymmetric cross-section, as well as significant variations in thickness.

As used herein the term sharply defined cross-color interface (500) refers to the location on the golf grip (10), after complete cross-linking during molding, at which opposing color interface edges, such as 336 and 436 or 346 and 446, of differing color preforms are originally abutted. An interface transition zone (510) is the region that is within 0.150 inch on either side of these interface edges, as seen in FIGS. 2 and 3, meaning that the transition zone width (520) is 0.300 inch. Thus, a sharply defined cross-color interface (500) is one in which no pigment from a preform can be optically detected outside the interface transition zone (510) on the other side of the location of the interface edge upon completed compression molding of the golf grip (10).

One embodiment achieves this sharply defined cross-color interface (500) by selectively limiting the quantity of blowing agent in the preforms, while still including a sufficient quantity to achieve the desired density. For instance, in one symmetrical swing grip embodiment the quantity of blowing agent in the preforms is at least 1 phr and less than 10 phr, while in a further embodiment the quantity of blowing agent in the preforms is at least 2 phr and less than 8 phr, while in still a further embodiment the quantity of blowing agent in the preforms is at least 3 phr and less than 7 phr. Achieving the sharply defined cross-color interface (500) is even more difficult when producing soft low-density asymmetric putter grips because the thickness of such asymmetric putter grips is several times greater than that of a conventional symmetric swing grip and may vary, which often necessitates additional layers of preforms, or partial preforms, to fill out the mold and achieve the desired profile. Such additional thickness, and the variability of the thickness throughout the length of the grip, further complicate the control of the reduced viscosity preforms during molding, as well as the stability of the much larger opposing color interface edges, such as 336 and 436 or 346 and 446. Thus, in an asymmetrical putter grip embodiment the quantity of blowing agent is at least 1 phr and less than 5 phr, while in an even further asymmetrical putter grip embodiment the quantity of blowing agent is at least 2 phr and less than 4 phr, and in yet a another asymmetrical putter grip embodiment the quantity of blowing agent is at least 2.5 phr and less than 3.5 phr; while still ensuring the density of the preforms, and the finished grip, is less than 0.90 g/cc. Not only does the blowing agent reduce the viscosity of the preforms during molding, but expanding blowing agents also increase the consolidation pressure at the interface edges during molding thereby further increasing the difficulty of obtaining a sharply defined cross-color interface (500), particularly when at least a portion of the thickness of a preform, such as, for example, the first section top preform (330) and the second section top preform (430), along a cross-color interface edge, such as, for example, the first section top preform interface edge (336) and the second section top preform interface edge (436), is greater than 0.125 inch.

Figure 8:
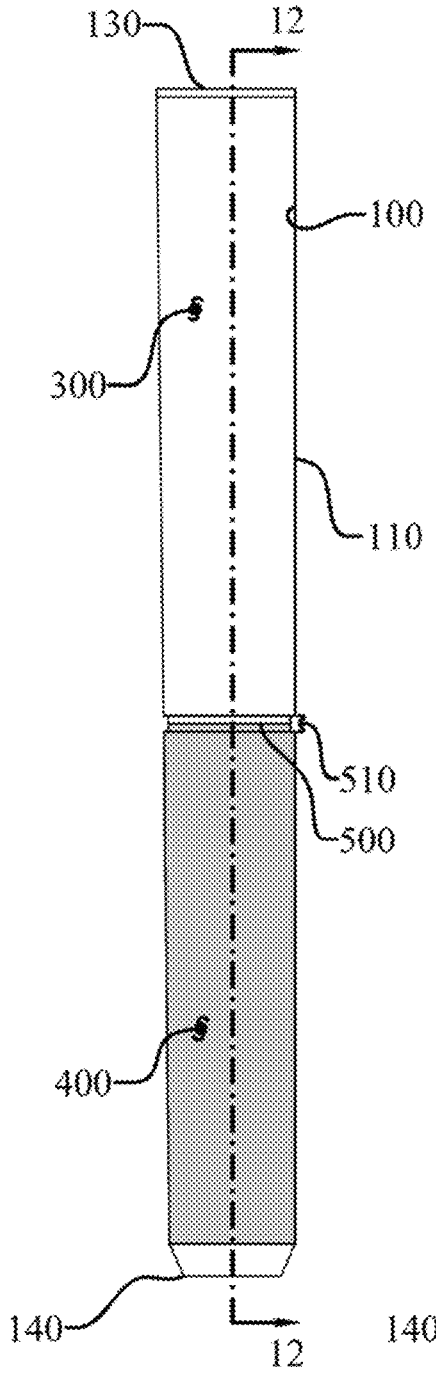
FIG. 8 shows a front elevation view of an embodiment of the golf grip, not to scale.
Figure 9:
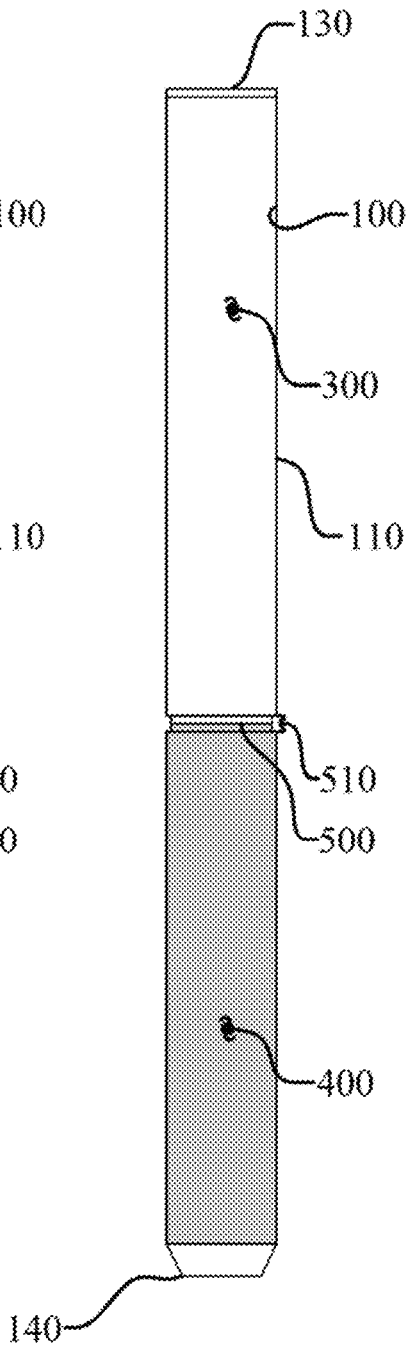
FIG. 9 shows a side elevation view of an embodiment of the golf grip, not to scale.
Figure 12:
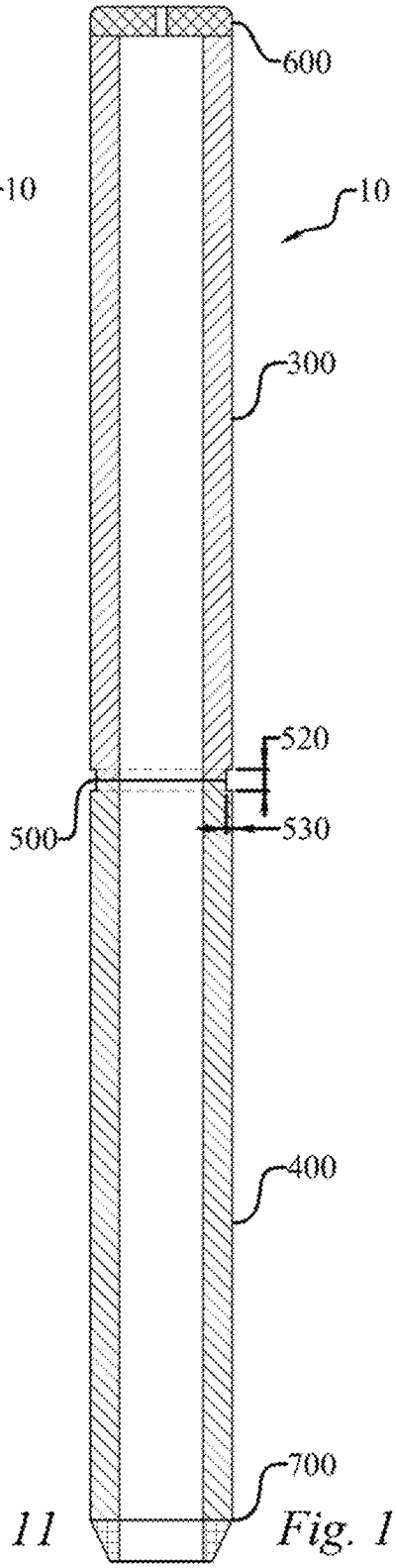
FIG. 12 shows a longitudinal cross-section, taken along section line 12-12 in FIG. 8, of an embodiment of the golf grip, not to scale.

An additional embodiment further improves the consistency of the cross-color interface (500) via the use of a mold that imparts a transition zone depth (530) within the interface transition zone (510), as seen in FIGS. 8, 9, and 12. The transition zone depth (530) is 0.003-0.012 inch, while in a further embodiment the transition zone depth (530) is 0.006-0.012 inch, while in an even further embodiment the transition zone depth (530) is 0.009-0.012 inch. The projections of the mold to facilitate the formation of the transition zone (510) may damage some of the expanding blowing agent in the preforms near the interface edges to control the expansion and additional consolidation pressure attributed to the expanding blowing agent, as well as stabilize the region in the immediate area of the interface edges. The transition zone depth (530) may extend into the grip from the exterior surface (110), as seen in FIGS. 8, 9, and 12, or it may extend into the grip from the interior surface (120) via a projection on the core rod (CR), not shown but understood to one skilled in the art; and an even further embodiment has a transition zone depth (530) extending into the grip from both the exterior surface (110) and the interior surface (120). In one embodiment the density of the completed golf grip (10) within the transition zone (510) is at least 2.5% greater than the overall density of the golf grip (10); while in a further embodiment the density of the completed golf grip (10) within the transition zone (510) is 2.5-10% greater than the overall density of the golf grip (10); while in an even further embodiment the density of the completed golf grip (10) within the transition zone (510) is 2.5-7.5% greater than the overall density of the golf grip (10). In a further embodiment the transition zone (510) includes a texture region including a plurality of texture region indentations, wherein some, or all, of the indentations extend continuously across the interface edges and the texture region indentations have a depth of less than 0.012 inch. In one embodiment each quadrant of the transition zone (510) includes at least two texture region indentations extending continuously across the interface edges, while in another embodiment at least one texture region indentation in each quadrant has a length of 0.100"-0.300" and the depth is 0.003"-0.012", and in yet a further embodiment each quadrant of the transition zone (510) includes at least two texture region indentations that are not parallel, and in one embodiment at least one of them is not parallel to the longitudinal axis of the golf grip (10), and in another embodiment the axis of the at least two of the texture region indentations in each quadrant vary by at least 30 degrees, at least 45 degrees in another embodiment, and at least 60 degrees in still a further embodiment. Such texture region indentations are designed to damage some of the expanding blowing agent in the preforms near the interface edges to further control the expansion and additional consolidation pressure attributed to the expanding blowing agent, stabilize the region in the immediate area of the interface edges, and provide additional contact area with the mold in the transition zone (510) to further reduce movement of the preforms at the interface edges.

Another embodiment improves the consistency of the cross-color interface (500) by increasing the contact area of abutting preforms opposing color interface edges, such as 336 and 436 or 346 and 446, to increase the stability of the interface and reduce the flow during molding associated with increased viscosity, as well as better distribute the consolidation pressure associated with expanding blowing agent embodiments. In order to quantify this increased contact area one must first establish a baseline contact area for comparison. The baseline contact area will first be defined for two scenarios, namely (a) where the first section (300) and second section (400) are configured adjacent to one another to transversely divide the golf grip (10), as seen in FIG. 2, and (b) where the first section (300) and second section (400) are configured adjacent to one another to longitudinally divide the golf grip (10), as seen in FIG. 26. For scenario (a) the baseline contact area is defined as the average cross-sectional area (152), seen in FIG. 5, taken in a section that is orthogonal to the axis of the golf grip (10), which can be thought of as sliding section line 5-5 along the length of the golf grip (10) from butt end (130) to tip end (140) and determining the cross-sectional area (152) at each point, then using the average of these cross-sectional areas as the baseline contact area. Similarly, for scenario (b) the baseline contact area is defined as the average cross-sectional area taken in a section that is parallel to the axis of the golf grip (10) when taken in 10 degree increments throughout the entire 360 degrees of the golf grip (10).

Now, in the embodiment of FIG. 13, the contact area of abutting preforms is the length of the first section top preform interface edge (336) multiplied by the thickness, which may vary, of the first section top preform (330) along the edge, added to the length of the first section bottom preform interface edge (346) multiplied by the thickness, which may vary, of the first section bottom preform (340) along the edge. One skilled in the art will appreciate that using the second section will arrive at the same contact area, assuming the thickness is the same at the abutting edges. Likewise the same procedure is used to obtain the contact area for longitudinally divided golf grips (10) such as the embodiment seen in FIG. 26. The procedure is the same whether the abutting edges are straight, curved, or a combination of straight sections and curved sections. Now, in one embodiment the sharply defined cross-color interface (500) is obtained by having a contact area of abutting preforms that is at least 5% greater than the baseline contact area, while in another embodiment the contact area of abutting preforms is at least 15% greater than the baseline contact area, and in yet an even further embodiment the contact area of abutting preforms is at least 30% greater than the baseline contact area. In another series of embodiments the sharply defined cross-color interface (500) is obtained by having a contact area of abutting preforms that is 5-60% greater than the baseline contact area, while in another embodiment the contact area of abutting preforms is 10-50% greater than the baseline contact area, and in yet an even further embodiment the contact area of abutting preforms is 15-45% greater than the baseline contact area. Increasing the contact area of abutting preforms opposing color interface edges, such as 336 and 436 or 346 and 446, increases the stability of the interface and reduce the flow during molding associated with increased viscosity, as well as better distribute the consolidation pressure associated with expanding blowing agent embodiments.

Still further embodiments improve the consistency of the cross-color interface (500) by introducing complementary geometries at opposing color interface edges, such as 336 and 436 or 346 and 446, to increase the stability of the interface and reduce the flow during molding associated with increased viscosity, as well as better distribute the consolidation pressure associated with expanding blowing agent embodiments. Thus, in one embodiment at least one of the interface edges (336, 346) of a first section preform (330, 340) has a first section edge geometry that cooperates with a second section edge geometry on at least one of the second section preform interface edges (436, 446) to further stabilize the interface. One example of such cooperating edge geometries is an apex geometry on one edge, shown as a first section apex geometry (360) and a second section apex geometry (460), and a cooperating receiver geometry on the abutting edge, shown as a second section receiver geometry (470) and a first section receiver geometry (370), such as seen in FIG. 13.

In one such embodiment the apex geometry (360 or 460) has two converging sides that approach one another at a convergence angle of 120 degrees or less, which in a further embodiment is 90 degrees or less, and is 60 degrees or less in an even further embodiment, shown as a first section convergence angle (362) or a second section convergence angle (462). In another embodiment each side has a straight section that is at least 0.250" long, while in another embodiment each straight section is at least 0.375" long, and in yet an even further embodiment the length of the apex geometry along the longitudinal axis of the golf grip (10) is at least 70% of the maximum transverse width of the apex geometry. In the embodiment of FIG. 13, the length of the apex geometry along the longitudinal axis of the golf grip (10) is a first section apex geometry length (362) or a second section apex geometry length (462); and the maximum transverse width of the apex geometry is a first section apex geometry width (364) or a second section apex geometry width (464). While in this particular embodiment the apex geometry widths (364, 464) are the full width of the preform, one skilled in the art will appreciate the corresponding widths in embodiments having multiple apex geometries such as a saw-tooth pattern. One particularly effective apex geometry converges to an apex point, or sharp first section apex (366) or sharp second section apex (466), with at least two straight sections of at least 0.250" converging at an angle of 90 degrees or less. A further embodiment includes a series of apexes to provide a saw-tooth pattern on an interface edge, which in one embodiment extend all the way around the circumference of the golf grip (10).

Figure 6:
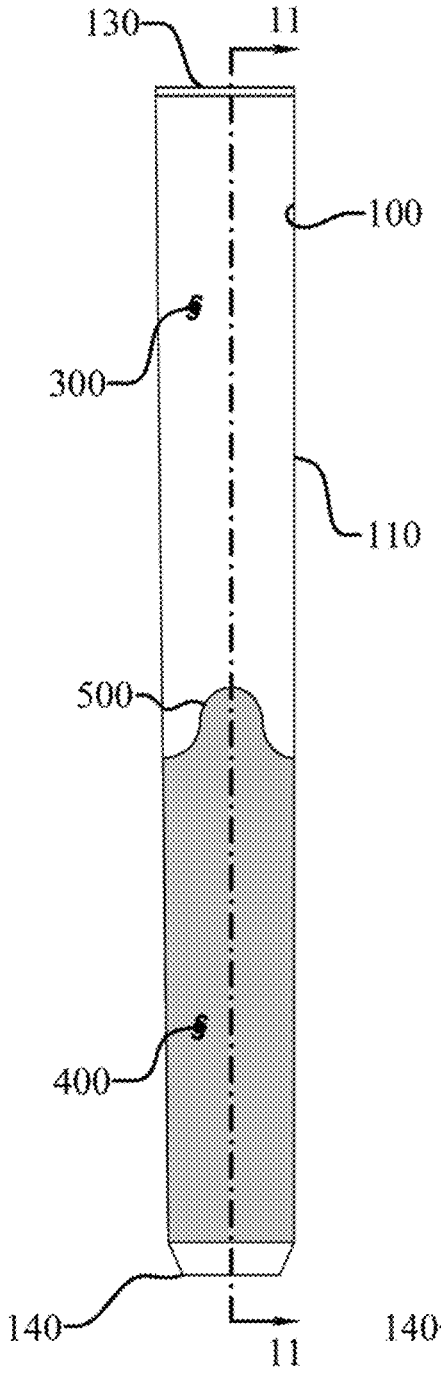
FIG. 6 shows a front elevation view of an embodiment of the golf grip, not to scale.
Figure 7:
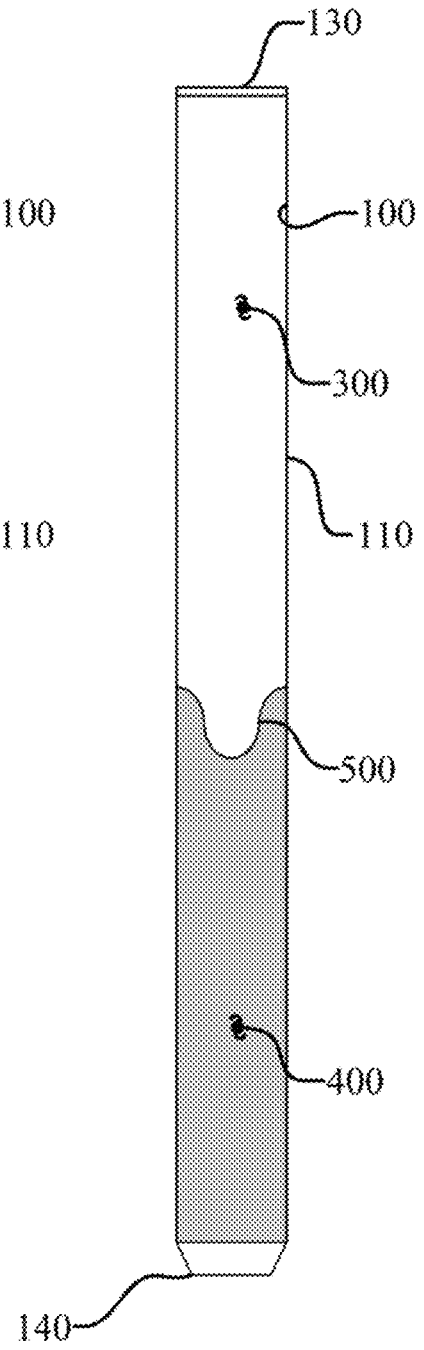
FIG. 7 shows a side elevation view of an embodiment of the golf grip, not to scale.

In another embodiment, such as that seen in FIGS. 6 and 7, the cooperating edge geometry includes a concave portion of a curve on one edge and a cooperating convex portion of a curve on the abutting edge, which in these embodiments remains an apex geometry. In still a further embodiment each abutting interface edge includes both a concave portion and a convex portion. Even further, in another embodiment, not shown but easily understood with reference to FIG. 7, a portion of the apex geometry has a width that is greater toward the distal end of the apex geometry than at least one point located proximally so that it interlocks with the abutting section much like pieces of a puzzle.

Figure 5:
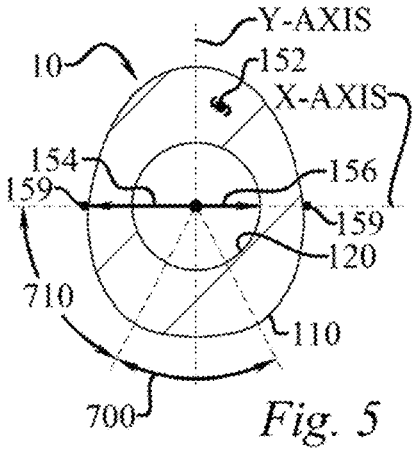
FIG. 5 shows a transverse cross-section, taken along section line 5-5 in FIG. 2, of an embodiment of the golf grip, not to scale.

In one embodiment the tip of the apex geometry is located on a flat portion of a putter embodiment of the golf grip (10), where one, or both, of the thumbs are generally placed while gripping a putter grip, such as that seen in FIGS. 2-5. Another way of defining the location of the tip of the apex geometry is in reference to a cross-section, as seen in FIG. 5. In the cross-section an imaginary x-axis and y-axis exist, and the points that the x-axis intersect with the exterior surface of the golf grip (10) are the x-axis exterior surface points (159). Generally the x-axis exterior surface points (159) also correspond with the meeting of the mold halves, or the parting lines. In one embodiment an apex tip is located within an apex tip location range (700) of 60 degrees or less, which begins at a range angle (710) of at least 60 degrees from the x-axis; while in a further embodiment the apex tip location range (700) is 30 degrees or less, which begins at a range angle (710) of at least 75 degrees from the x-axis; in yet a further embodiment the apex tip location range (700) is 20 degrees or less, which begins at a range angle (710) of at least 80 degrees from the x-axis; and in still a further embodiment the apex tip location range (700) is 10 degrees or less, which begins at a range angle (710) of at least 85 degrees from the x-axis. In one embodiment, such as that seen in FIG. 2, at least one apex tip is located approximately 90 degrees from the x-axis; while another embodiment incorporates two apex geometries with each apex tip located on opposing halves of the golf grip (10), and in a further embodiment each apex tip is located approximately 180 degrees from one another and approximately 90 degrees from the x-axis, as seen in FIGS. 2-5, 13, and 14. Another embodiment, seen in FIG. 13, includes a first section apex geometry (360), located on the front half of the golf grip (10), and a second section apex geometry (460), located on the rear half of the golf grip (10), with the apex geometries located approximately 180 degrees apart and located on differing color preforms, thus providing a converging apex geometry in one color in the front and a second converging apex geometry in another color in the rear.

The disclosed locations of the apex tip, as well as the incorporation of angled, or converging, sides and/or concave/convex portions, not only increases the contact area of abutting preforms opposing color interface edges, such as 336 and 436 or 346 and 446, and increase the stability of the interface and reduce the flow during molding associated with increased viscosity, but these features also direct and control material expansion during molding as the consolidation pressure builds by reducing directly opposing consolidation forces at the edges which promote interface irregularity. Further, these features reduce rubber migration during molding, particularly during the degassing phase during which the mold is opened and closed several times during the first minute of the molding process.

As seen in FIGS. 19 and 20, a section may be inset and at least partially surrounded by the other section. Such embodiments exhibit the same difficulties described elsewhere herein and achieve the desired sharply defined cross-color interface (500) using the techniques disclosed herein with respect to the transversely divided golf grip (10) of FIG. 2 and the longitudinally divided golf grip (10) of FIGS. 25 and 26. The butt end insert, or second section (400) shown at the top of FIGS. 25 and 26, includes at least one converging apex geometry along the interface edge; in fact, this embodiment includes two acute apex geometries at the top of the second section (400) and one apex geometry at the bottom of the second section (400). Further, the tip end insert, or second section (400) shown at the bottom of FIGS. 25 and 26, includes multiple concave sections along the interface edge.

Figure 18:
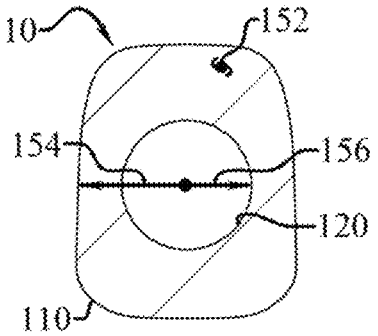
FIG. 18 shows a transverse cross-section, taken along section line 18-18 in FIG. 16, of an embodiment of the golf grip, not to scale.

All of these complementary geometry embodiments at opposing color interface edges, such as 336 and 436 or 346 and 446, increase the stability of the interface and reduce the flow during molding associated with increased viscosity, promote cross-linking of the sections, and better distribute the consolidation pressure associated with expanding blowing agent embodiments, to better achieve a sharply defined cross-color interface (500), particularly when at least a portion of the thickness of a preform, such as, for example, the first section top preform (330) and the second section top preform (430), along a cross-color interface edge, such as, for example, the first section top preform interface edge (336) and the second section top preform interface edge (436), is greater than 0.125 inch. Thus, in one embodiment at least a portion of the thickness of a preform, such as, for example, the first section top preform (330) and the second section top preform (430), along a cross-color interface edge, such as, for example, the first section top preform interface edge (336) and the second section top preform interface edge (436), is greater than 0.125 inch, while in another embodiment at least a portion of the thickness along the cross-color interface edge is at least 0.200 inch, and is at least 0.250 inch in an even further embodiment; which may be achieved with a single layer preform at the interface edge, or in some embodiments include multiple preform layers at the interface edge. As one skilled in the art will appreciate, embodiments having multiple preform layers, or significant variations of the exterior surface cross-sectional radius (154) seen in FIGS. 5 and 18, at the interface edge further compounds the difficulty in achieving a sharply defined cross-color interface (500), however the embodiments disclosed herein control the movement and expansion of the preforms during molding and create the desired sharply defined cross-color interface (500).

Traditional opposing, or cross-color, interface edges are generally of a skived configuration, in other words they overlap to some degree. Such overlapping at the interface, particularly one associated with the soft low-density materials, which exhibiting higher viscosity during molding, disclosed herein, promotes instability and movement at the interface, as well as pigment migration. As seen in FIGS. 10-12 and 15, one embodiment of the present golf grip (10)

utilizes preforms that are cut so that the opposing color interface edges, such as 336 and 436 or 346 and 446, are ninety degree butt joints when abutted, plus or minus five degrees. In fact, in one embodiment the preforms are cut so that the opposing color interface edges, such as 336 and 436 or 346 and 446, are ninety degree butt joints, or less, when abutted to ensure there is no overlaps of the abutting preforms; in fact, in one embodiment the opposing color interface edges, such as 336 and 436 or 346 and 446, are 80-90 degrees, while in a further embodiment they are 85-90 degrees, and in yet an even further embodiment they are 80-89 degrees. Such ninety degree, or less, butt joints help provide additional stability at the interface by accommodating increased consolidation pressure associated with expanding blowing agent embodiments to achieve the desired sharply defined cross-color interface (500).

In a further embodiment the density of at least one of the preforms is less than 0.85 g/cc and the overall golf grip (10) density is less than 0.90 g/cc; while in another embodiment at least one of the preforms has a density of less than 0.80 g/cc and the overall golf grip (10) density is less than 0.85 g/cc; and in yet another embodiment the density of all of the preforms is 0.60-0.90 g/cc and the overall golf grip (10) density is 0.75-0.90 g/cc. In still further embodiments any of the sections may further include materials to create a corded grip structure, as would be understood by one of skill in the art.

It is worth noting that the embodiments described herein with respect to a first section (300) and a second section (400) are not limited to two sections. For instance it is easy to visualize the transversely divided golf grip (10) of FIG. 2 as having a third, or even a fourth, section at either end of the golf grip (10), and likewise with the longitudinally divided golf grip (10) of FIG. 25, where any number of sections may be joined together to form the golf grip (10) and achieve the desired look of differing color sections, which could be every ⅓ of the circumference, every quadrant, every octant, or anything in between.

Figure 21:
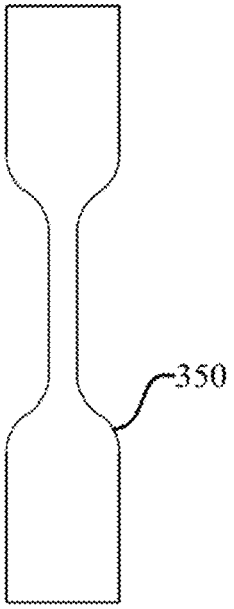
FIG. 21 shows a front elevation view of a test specimen, not to scale.
Figure 22:
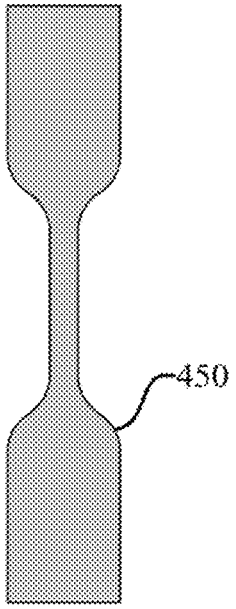
FIG. 22 shows a front elevation view of a test specimen, not to scale.
Figure 23:
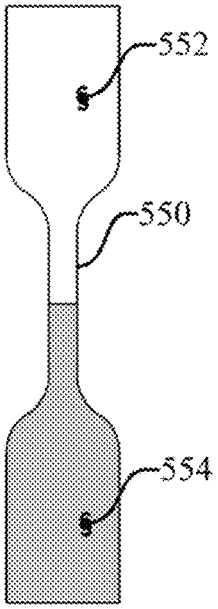
FIG. 23 shows a front elevation view of a test specimen, not to scale.

The present embodiments not only achieve the desired sharply defined cross-color interface (500) along the intersection of the differing colors of the first section (300) and the second section (400), but also provide the interface stability necessary to ensure a strong failure resistant cross-color interface (500). For example, a first section test specimen (350), seen in FIG. 21, a second section test specimen (450), seen in FIG. 22, and an interface test specimen (550) having an interface test specimen first section (552) and an interface test specimen second section (554), seen in FIG. 23, of identical size were cut out of test slabs created and cured using the materials, configurations, and methods disclosed herein in order to perform tensile testing; in fact, three of each test specimen were created. Each test specimen was installed in a TechPro TensiTech+ tensile tester and a tensile load was applied until failure of the test specimens. The results of this tensile testing are summarized in Table 1.

TABLE 1

| | Tensile Strength (psi) | | |
|---|---|---|---|
| Trial | first section test specimen (350) | second section test specimen (450) | interface test specimen (550) |
| 1 | 317.2 | 363.4 | 353.2 |
| 2 | 351.5 | 385.9 | 314.6 |
| 3 | 298.2 | 377.2 | 337 |
| Avg. | 322.3 | 375.5 | 334.9 |

Figure 24:
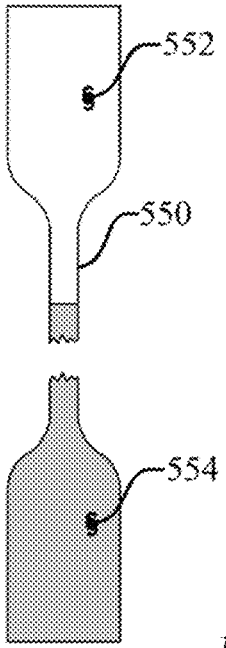
FIG. 24 shows a front elevation view of a test specimen, not to scale.

Each of the three interface test specimens (550) failed away from the sharply defined cross-color interface (500), as shown in FIG. 24, illustrating that the interface has greater tensile strength than at least one of the first section (300) and the second section (400). Thus, in one embodiment the sharply defined cross-color interface (500) has a tensile strength of at least 300 psi.

The interface transition zone (510) was previously defined as the region that is within 0.150 inch on either side of these interface edges, as seen in FIGS. 2 and 3, meaning that the transition zone width (520) is 0.300 inch; and the sharply defined cross-color interface (500) was previously defined as one in which no pigment from a preform can be optically detected outside the interface transition zone (510) on the other side of the location of the interface edge upon completed compression molding of the golf grip (10). However, in a further embodiment the disclosed materials and configurations achieve a sharply defined cross-color interface (500) with an interface transition zone (510) that is the region that is within 0.100 inch on either side of these interface edges, as seen in FIGS. 2 and 3, meaning that in this embodiment the transition zone width (520) is 0.200 inch; while in an even further embodiment the interface transition zone (510) is the region that is within 0.050 inch on either side of these interface edges, as seen in FIGS. 2 and 3, meaning that in this embodiment the transition zone width (520) is 0.100 inch A further benefit of the present golf grip (10) is improved feel. Traditionally compression molded elastomer compound grips feel hard or firm, which is undesirable in a putter grip. Further, the hardness or softness of a golf grip is best reflected using a compression test mimicking what a player actually feels when the grip is installed on a club rather than based solely on material property tests. Thus, the goal of an embodiment is to produce a soft compression molded golf grip (10) that is pleasing to the touch. A soft low-density compression molded elastomer compound golf grip (10) that compresses when squeezed by the fingers or hand can provide a comfort and training aid for golfers. After all, the putting stroke is best executed when the golfer is in a relaxed state. This occurs when the grip pressure squeezing the putter grip is light. Having a soft compressible putter grip reminds the golfer to relax the grip pressure. If the golf grip (10) can be compressed, then the golfer is reminded that they are exerting too high a grip pressure. However, a soft low-density compression molded elastomer compound golf grip (10) must also be resilient. In other words, when grip pressure is relaxed, the compressed material must return to its original shape and volume; if it doesn't, it will be considered nonconforming by the rules of golf. Thus, a golf grip must not be permanently deformable, otherwise the golfer can create a custom shaped grip to position and align the hands, which is not allowed. The present elastomer compounds are thermoset based. The vulcanization process creates a cross linking of the polymer chains that is strong and resilient. Therefore a thermoset elastomer compound may be molded in a low durometer formula and retain resiliency better than thermoplastic materials.

Figure 28:
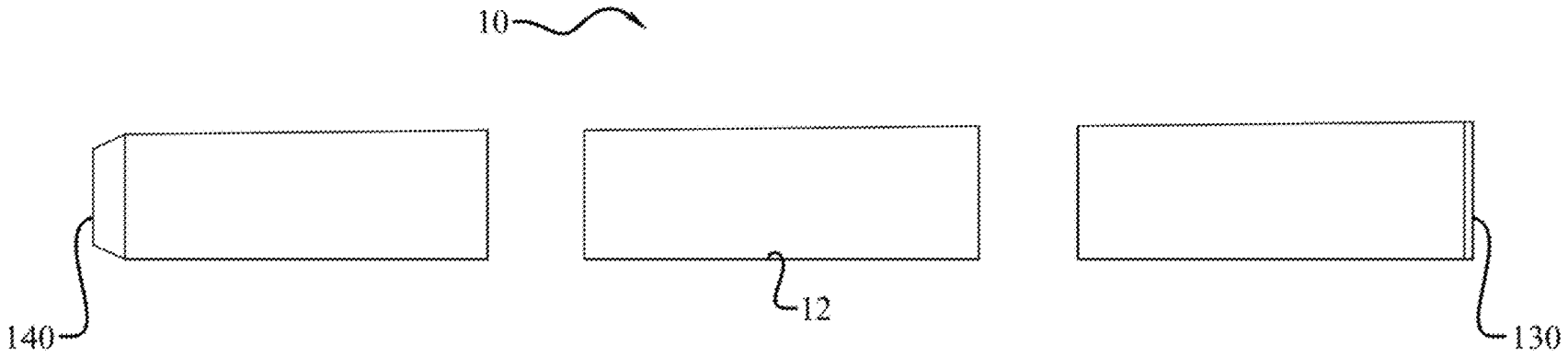
FIG. 28 shows a golf grip evenly sectioned into three sections, not to scale.
Figure 29:
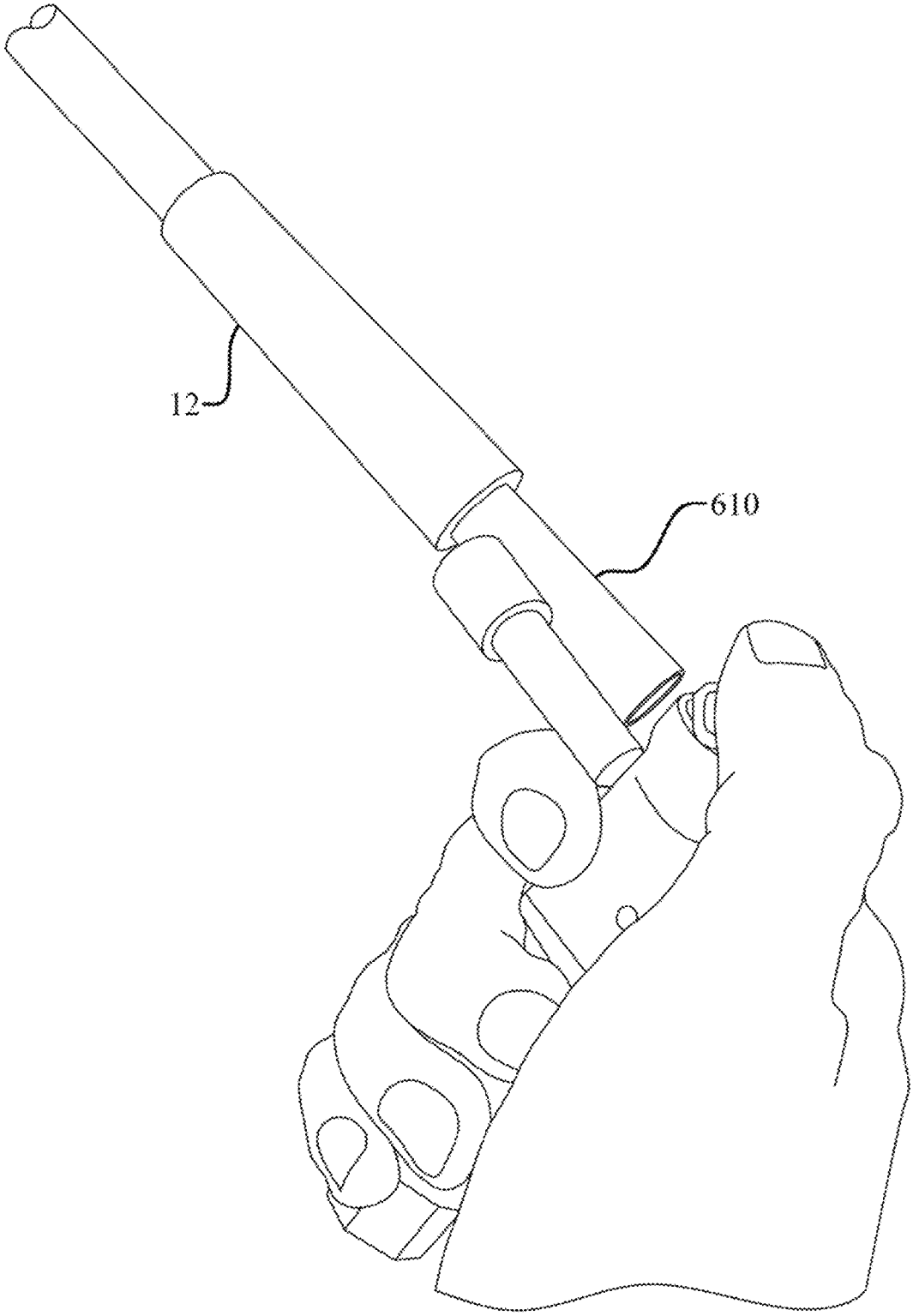
FIG. 29 shows the middle section of the golf grip of FIG. 27 being installed on a mandrel using compressed air, not to scale.
Figure 30:
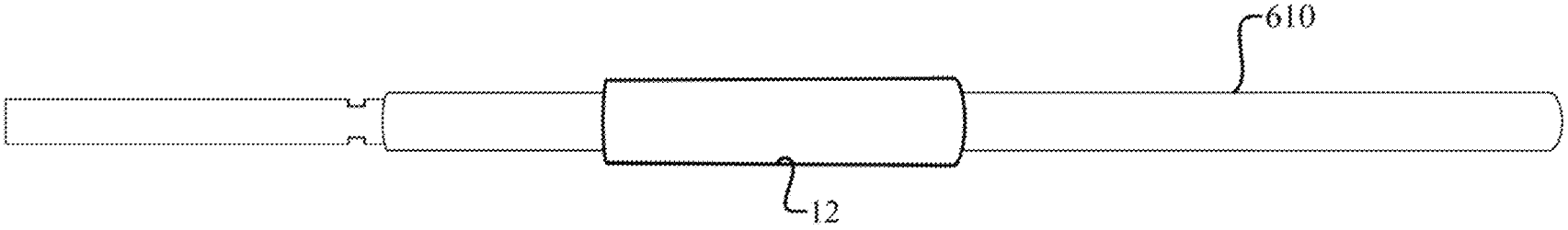
FIG. 30 shows the middle section of the golf grip of FIG. 27 installed in the middle of the mandrel, not to scale.
Figure 31:
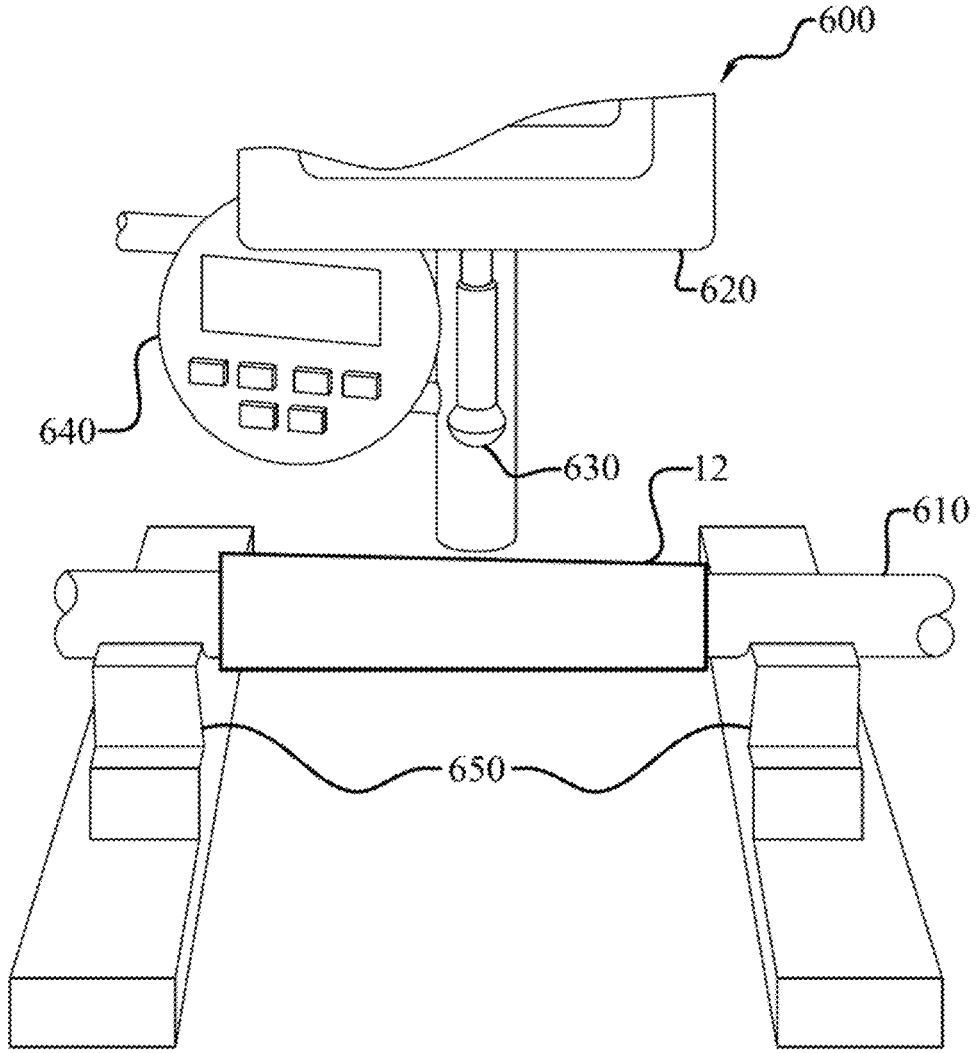
FIG. 31 shows a close up view of the mandrel installed on V-blocks in the test station, not to scale.
Figure 32:
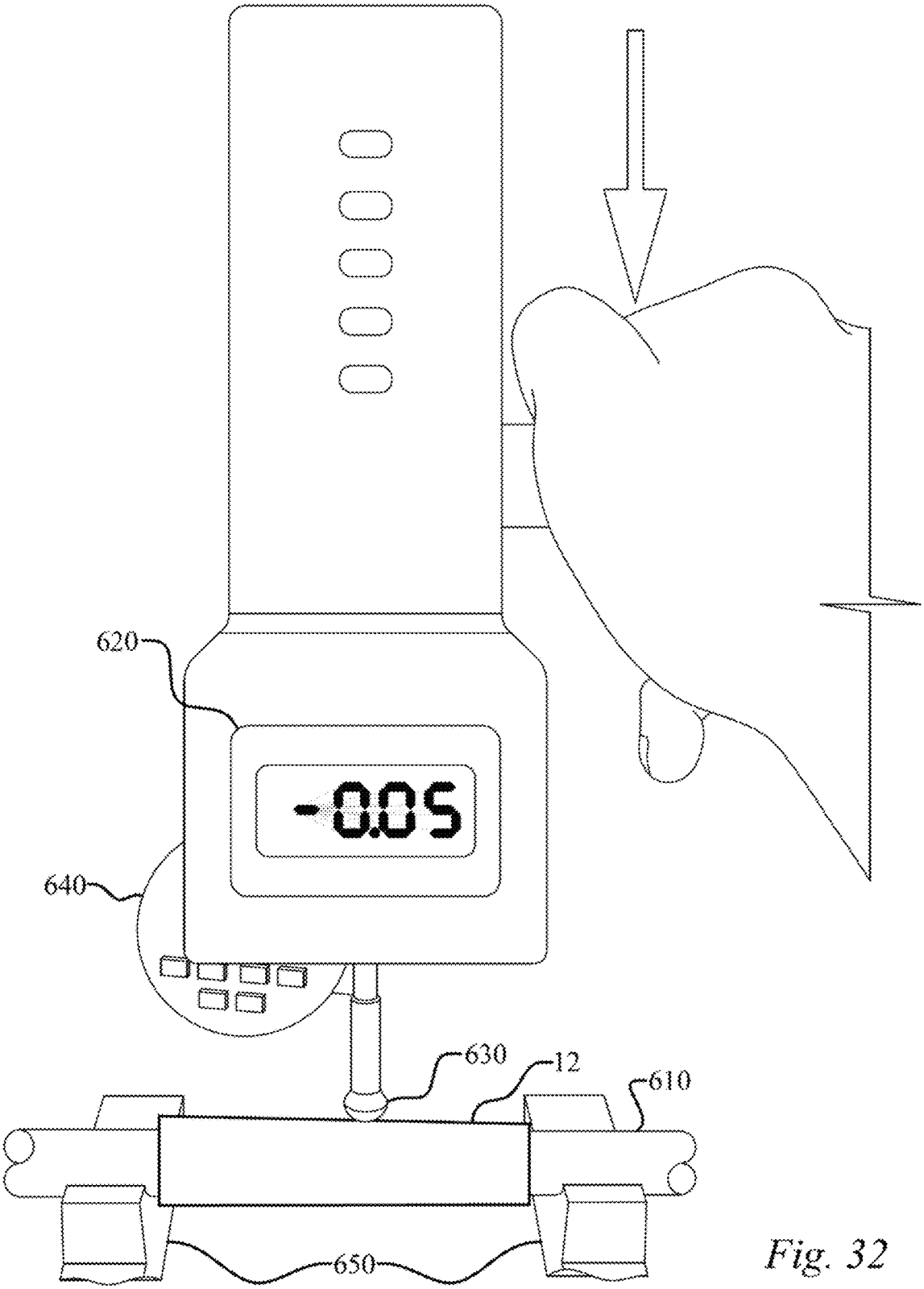
FIG. 32 shows a force gauge and probe of the test station coming in contact with the middle section of the golf grip, not to scale.
Figure 33:
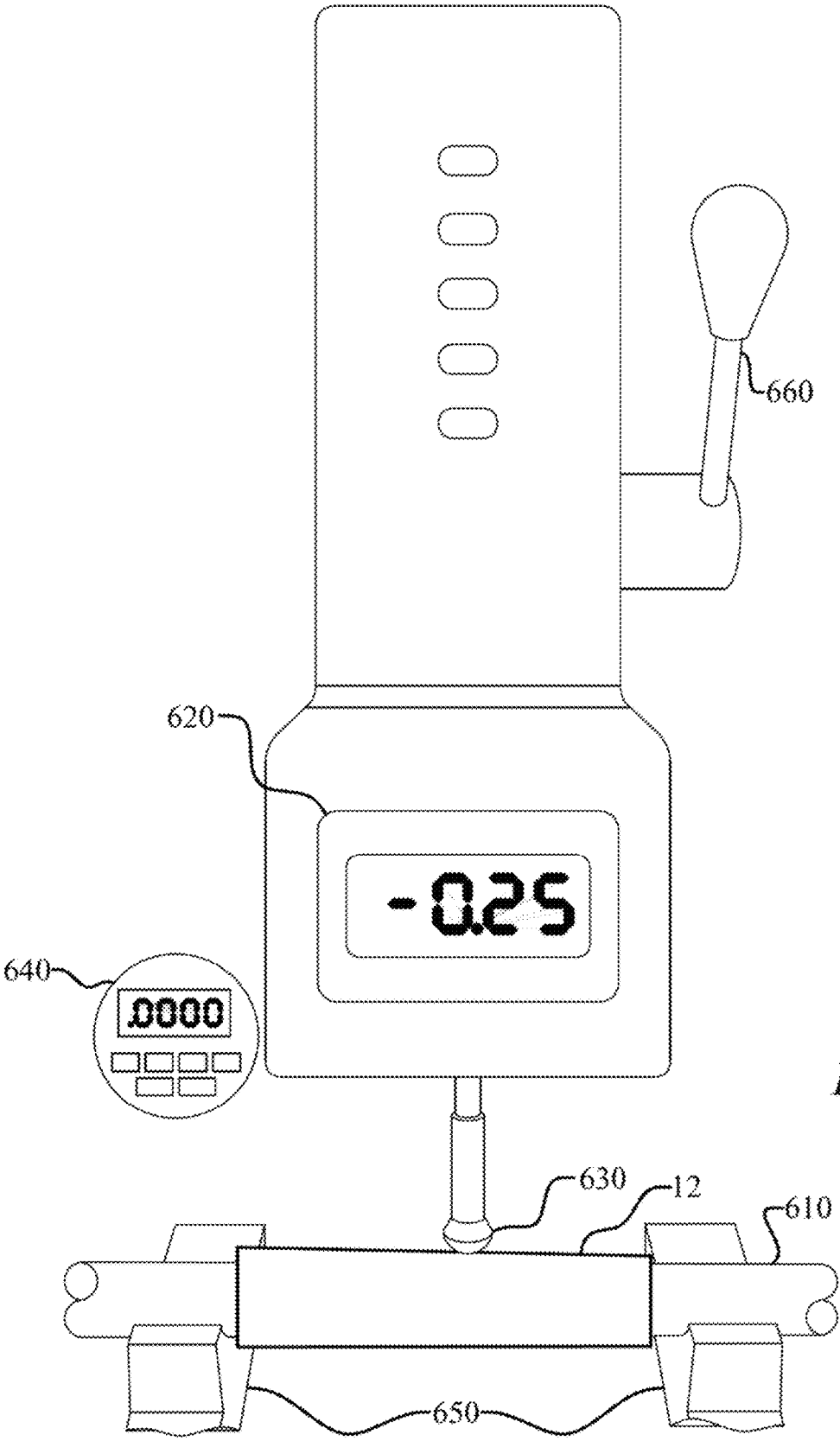
FIG. 33 shows a depth gauge of the test station being zeroed out when the probe first contacts the middle section of the golf grip, not to scale.
Figure 34:
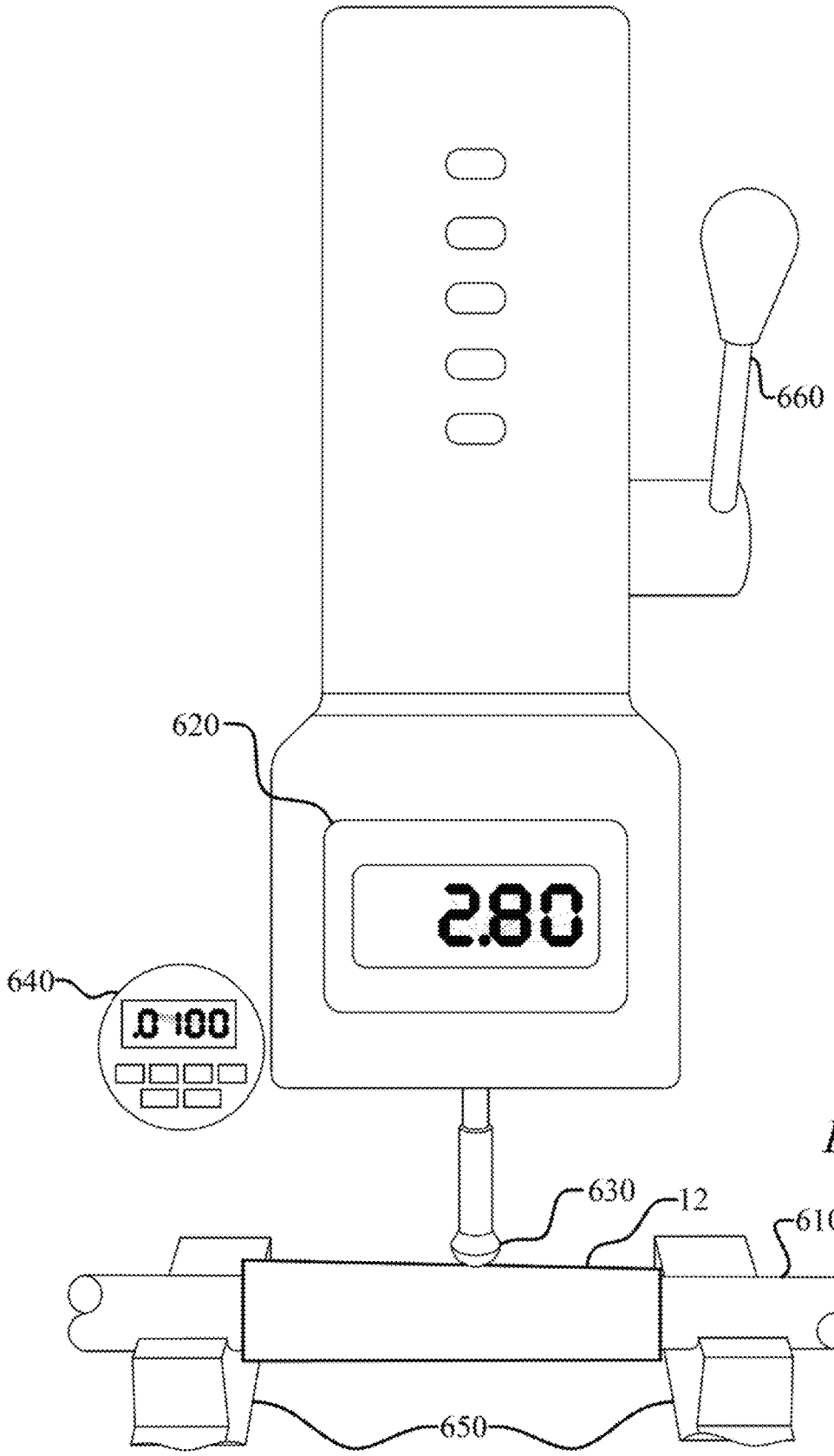
FIG. 34 shows the force gauge measurement when the probe has been forced against the middle section of the golf grip to compress it 0.01" as measured by the depth gauge, not to scale.
Figure 35:
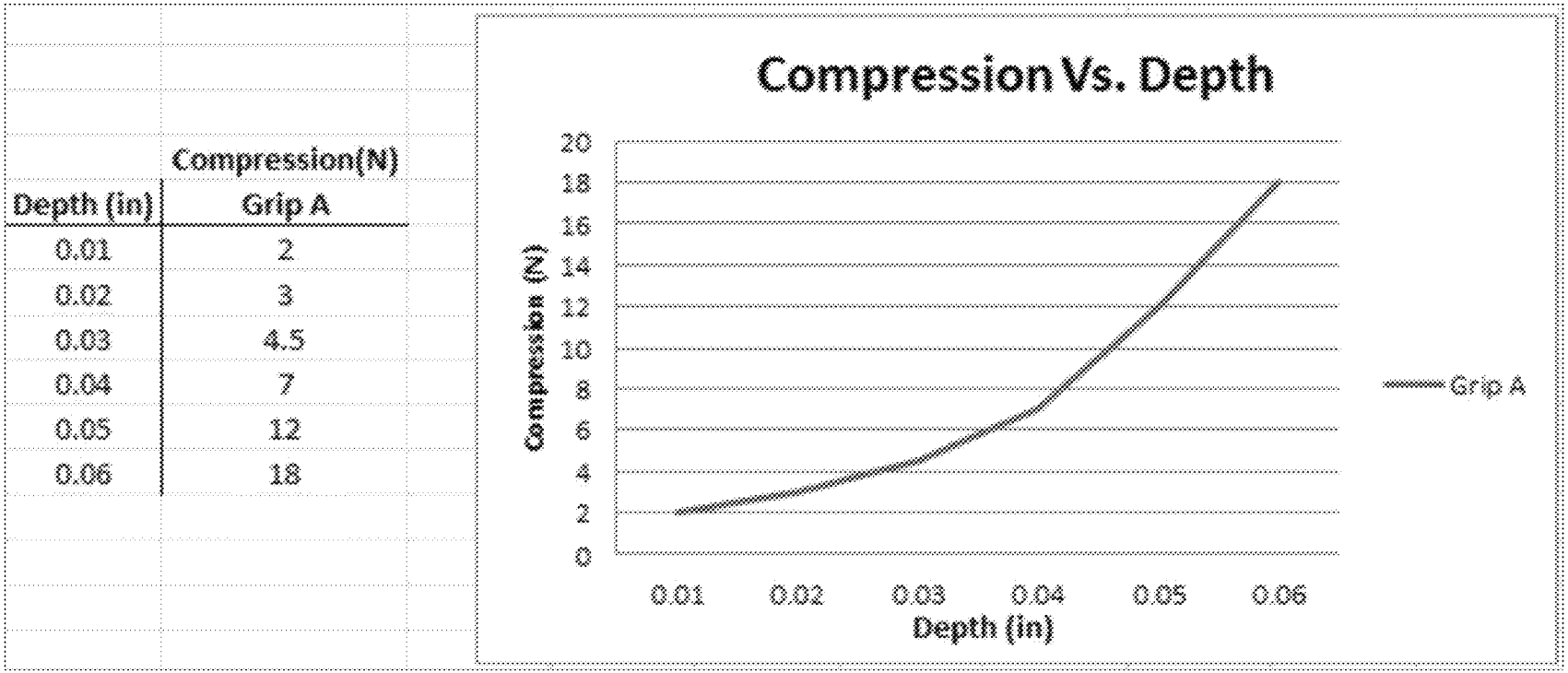
FIG. 35 shows a table and graph illustrating the compressive force necessary to force the probe into the middle section of the golf grip a compression depth of 0.01", 0.02", 0.03", 0.04", 0.05", and 0.06"

Next, a compression test procedure will be outlined and explained to determine the softness of a compression molded golf grip (10) at various depths or states of compression. The test fixture (600), seen in FIGS. 27, 31, 32, 33, and 34, includes a mandrel (610), a force gauge (620) with probe (630), a depth gauge (640), and a test stand (650). First, the golf grip (10) is cut into three equal length sections, as seen in FIG. 28. Second, the middle section (12) of the golf grip (10) is installed on a solid steel mandrel (610)

having a constant diameter of 0.580" without any grip tape and without using solvent; compressed air may be used to help position the middle section (12) of the golf grip (10) at the middle of the mandrel (610), as seen in FIGS. 29 and 30. Third, the middle section (12) is allowed to sit untouched for one hour to allow the material to relax and any trapped air can escape. Fourth, the mandrel (610) is placed on the test stand (650), which in this case consists of a pair of V-blocks, so that the middle of the middle section (12) of the golf grip (10) is directly under the probe (630) of the force gauge (620). The force gauge (620) is a digital force gauge equal to the Extech model 475044. The probe (630) is metal with a 0.40" diameter spherical tip, which fairly accurately represents the contact points of the human hand when holding a golf grip. Fifth, the lever (660) on the test fixture (600) is engaged slowly until the probe (630) contacts the golf grip (10) and the force gauge (620) first displays a reading, as seen in FIG. 32. Sixth, with the probe (630) in contact with the middle section (12) and the force gauge (620) reading 0.25 N or less, zero out the depth gauge (640), as seen in FIG. 33. The depth gauge (640) is a digital depth gauge equal to the Fowler Ultra-Logic. Seventh, slowly force the probe (630) against the golf grip (10) until the depth gauge (640) senses a depth of 0.01" and read the force sensed by the force gauge (620), as seen in FIG. 34. Eighth, repeat step seven to record the force necessary to achieve probe depths of 0.02", 0.03", 0.04", 0.05", and 0.06". Lastly, record the measured forces in a table or graph such as those seen in FIG. 35. While the figures accompanying this procedure illustrate a symmetrical round swing grip for simplicity, the same procedure is used for asymmetrical putter grips and they are positioned in the test stand so that the flat thumb surface of the grip is horizontal beneath the probe (630) so that the probe (630) contacts the middle of the flat thumb surface at a ninety degree angle.

Figure 36:
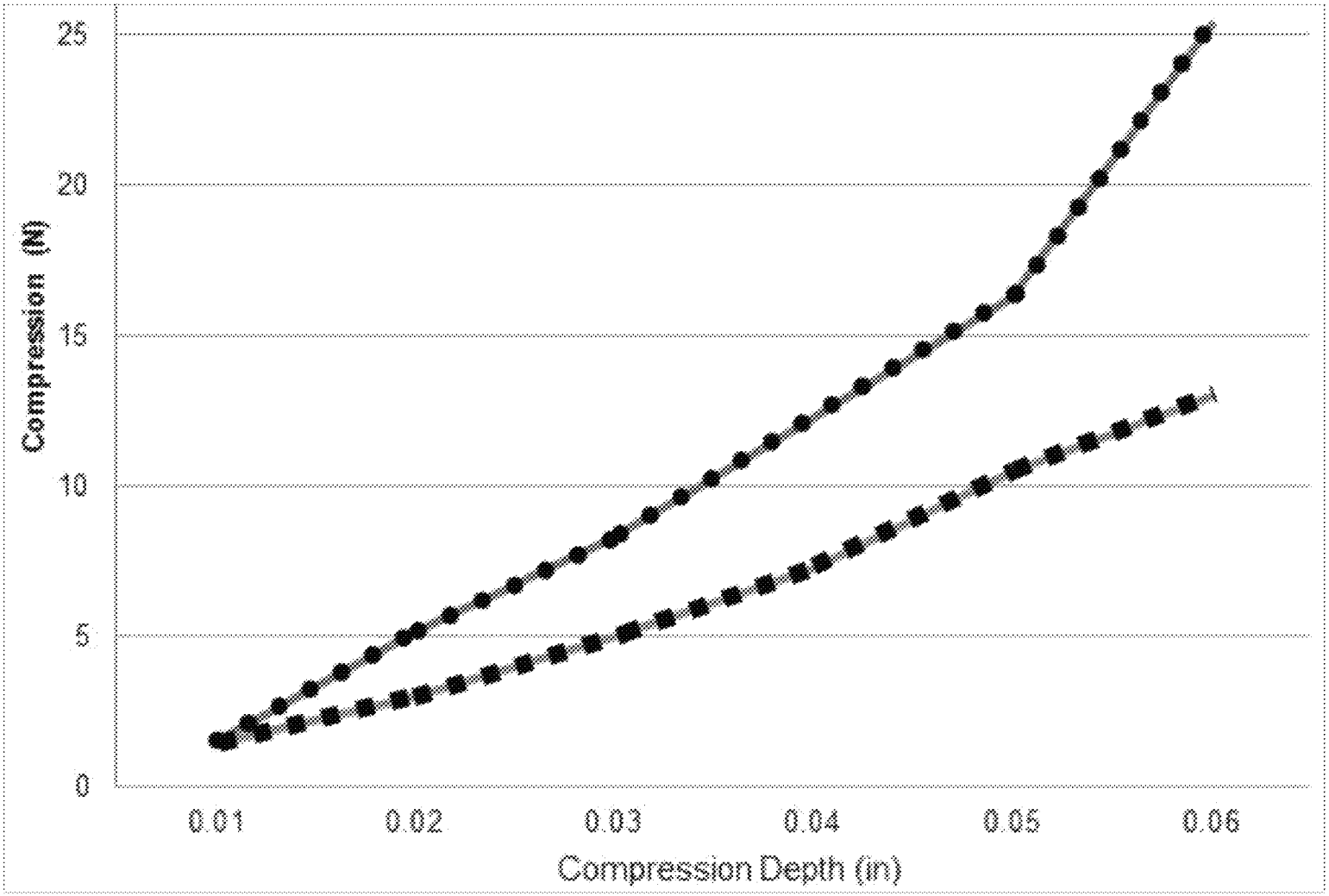
FIG. 36 shows a graph illustrating the data collected for a competitor's lightweight oversized putter grip composed of a foam body covered with a polyurethane exterior layer, represented by the line with circular dots, and an embodiment of the present invention represented by the line with the square dots.

FIG. 36 represents the data collected using the above test procedure for a competitor's lightweight oversized putter grip composed of a foam body covered with a polyurethane exterior layer, represented by the line with circular dots, and an embodiment of the present invention represented by the line with the square dots. Both grips are approximately the same size and volume. When comparing the compressive force required to achieve deflections of 0.02", 0.03", 0.04", 0.05", and 0.06", it is easy to see that the competitor's grip requires 50-100% greater compressive force than that of the present invention to obtain the same deflection. Alternatively, another way to appreciate the significance of FIG. 36 is to look at the deflection of the two grips from an identical compressive force. For instance, at a compressive force of 5 N the embodiment of the present invention has deflected 50% more than the competitor's grip, and likewise at 10 N. The best feedback for a golfer regarding grip pressure is to provide a grip with a relatively consistent and relatively flat line so that a golfer's grip never gets to the point of strongly squeezing the golf grip without sensing any additional deflection. Likewise, consistency of a ratio of the compressive force to the compression depth throughout a range of compression depths, while still providing the necessary resiliency, provides improved feedback to a golfer indicating that their grip pressure is too high.

Thus, in one embodiment a compression ratio of the compressive force, in Newton, to the compression distance, in inches, does not exceed 300 N/inch throughout a compression depth range of 0.01" to 0.05"; whereas in another embodiment the compression ratio does not exceed 250 N/inch throughout a compression depth range of 0.01" to 0.05"; while in another embodiment the compression ratio does not exceed 225 N/inch throughout a compression depth range of 0.01" to 0.05"; and in yet another embodiment the compression ratio does not exceed 205 N/inch throughout a compression depth range of 0.01" to 0.04". In yet another embodiment the slope of the line representing the compressive force in the Y-axis and the compression depth in the X-axis, as seen in FIG. 36, does not exceed 400 throughout a compression depth range of 0.01" to 0.05"; while in another embodiment the slope does not exceed 350 throughout a compression depth range of 0.01" to 0.05"; and in yet a further embodiment the slope does not exceed 325 throughout a compression depth range of 0.01" to 0.05". In still a further embodiment the compressive force does not exceed 10 N throughout a compression depth range of 0.01" to 0.04"; while in another embodiment the compressive force does not exceed 8 N throughout a compression depth range of 0.01" to 0.04"; and in yet another embodiment the compressive force does not exceed 7.5 N throughout a compression depth range of 0.01" to 0.04".

In a further embodiment the compression ratio is 100-300 N/inch throughout a compression depth range of 0.01" to 0.05"; whereas in another embodiment the compression ratio is 125-250 N/inch throughout a compression depth range of 0.01" to 0.05"; while in another embodiment the compression ratio is 150-225 N/inch throughout a compression depth range of 0.01" to 0.05"; and in yet another embodiment the compression ratio is 125-205 N/inch throughout a compression depth range of 0.01" to 0.04". In yet another embodiment the slope of the line representing the compressive force in the Y-axis and the compression depth in the X-axis, as seen in FIG. 36, is 100-400 throughout a compression depth range of 0.01" to 0.05"; while in another embodiment the slope is 125-350 throughout a compression depth range of 0.01" to 0.05"; and in yet a further embodiment the slope is 150-325 throughout a compression depth range of 0.01" to 0.05". In still a further embodiment the compressive force is 1-10 N throughout a compression depth range of 0.01" to 0.04"; while in another embodiment the compressive force is 1-8 N throughout a compression depth range of 0.01" to 0.04"; and in yet another embodiment the compressive force is 1.5-7.5 N throughout a compression depth range of 0.01" to 0.04".

Another important factor in the golf swing is the ability to have proper feel. As seen in FIG. 5, each point along the length of the golf grip (10) has a cross-section characterized by a point specific cross-sectional area (152) and cross-sectional radius (154). In one embodiment specifically directed to a putter grip, at least one point along the length of the golf grip (10) has a cross-sectional area (152) of at least 3.75 $cm^2$, while in a further embodiment at least 50% of the length of the golf grip (10) has a cross-section having a cross-sectional area (152) of at least 3.75 $cm^2$. Still further, one embodiment has 85% of the length of the golf grip (10) has a cross-sectional area (152) of at least 3.75 $cm^2$.

The cross-sectional radius (154) is the radius from the center of the central opening in the golf grip (10) to the exterior surface (110). In one embodiment specifically directed to a putter grip, at least one point along the length of the golf grip (10) has a cross-sectional radius (154) of at least 0.46 in, while in a further embodiment throughout at least 50% of the length of the golf grip (10) a cross-sectional radius (154) is at least 0.46 in, and in yet another embodiment this is true throughout at least 85% of the length of the golf grip (10). In a further embodiment, at least one point along the length of the golf grip (10) has a cross-sectional radius (154) of at least 0.525 in, while in a further embodiment the golf grip (10) has a cross-sectional radius (154) of at least 0.525 in throughout at least 50% of the length of the golf grip (10), while in a further embodiment each cross-section throughout at least 85% of the length of the golf grip (10) has a cross-sectional radius (154) of at least 0.525 in. In a further relatively non-tapered embodiment at least 50% of the length of the golf grip (10) has cross-sections containing a cross-sectional radius (154) of 0.46-0.80 in; while in another embodiment at least 85% of the length of the golf grip (10) has cross-sections containing a cross-sectional radius (154) of 0.46-0.80 in.

A further oversized putter grip embodiment has at least one point along the length of the golf grip (10) has a cross-section having a cross-sectional area (152) of at least 5.25 $cm^2$, while in a further embodiment at least 50% of the length of the golf grip (10) has a cross-section having a cross-sectional area (152) of at least 5.25 $cm^2$. Still further, one embodiment has 85% of the length of the golf grip (10) possesses cross-sections having a cross-sectional area (152) of at least 5.25 $cm^2$. In one embodiment specifically directed to an oversized putter grip, at least one point along the length of the golf grip (10) has a cross-sectional radius (154) of at least 0.55 in, while in a further embodiment at least 50% of the length of the golf grip (10) has cross-sections having a cross-sectional radius (154) of at least 0.55 in. Still further, one embodiment has 85% of the length of the golf grip (10) having cross-sections with a cross-sectional radius (154) of at least 0.55 in. In a further relatively non-tapered embodiment at least 50% of the length of the golf grip (10) has cross-sections having a maximum cross-sectional radius (154) of 0.55-0.90 in; while in another embodiment at least 85% of the length of the golf grip (10) has cross-sections having a maximum cross-sectional radius (154) of 0.55-0.90 in. Further, in another embodiment at least one point on the exterior surface (110) has a cross-sectional radius (154) of at least 0.65 inches, while in another embodiment at least one point on the exterior surface (110) has a cross-sectional radius (154) of at least 0.75 inches.

Additionally, another putter grip embodiment has a volume of at least 100 cc and a weight of 50-145 grams, while a further embodiment has a volume of 100-130 cc and a weight of 55-120 grams, while a further embodiment has a volume of at least 135 cc and a weight of 90-160 grams, and an even further embodiment has a volume of 135-160 cc and a weight of 120-145 grams. In one embodiment the overall density of the entire golf grip (10) is 0.45-0.89 g/cc, while in a further embodiment the overall density of the entire golf grip (10) is 0.60-0.89 g/cc, and in an even further embodiment the overall density of the entire golf grip (10) is 0.70-0.89 g/cc.

As previously touched upon, the golf grip (10) may be formed of a plurality of layers in one or both sections (300, 400), including at least a first layer and a second layer. The individual layers may be adhered to each other, or joined in the compression molding process. In one such embodiment the first layer has a first layer thickness and the second layer has a second layer thickness, both being thicknesses measured before the actual manufacturing process, thus an uncured thickness. A further embodiment has a first layer thickness that is at least 25% greater than a second layer thickness. In one embodiment the first layer thickness is 1.50-3.00 mm and the second layer thickness is 1.25-2.50 mm; while in a further embodiment the first layer thickness is 2.00-2.80 mm and the second layer thickness is 1.70-2.25 mm; and in yet another embodiment the first layer thickness is 2.30-2.70 mm and the second layer thickness is 1.80-2.00 mm. Further, the first layer and the second layer may contain different quantities of blowing agent causing them to expand differently during the compression molding curing process. For instance, in one example the first layer has a quantity of blowing agent that is at least twice the quantity of blowing agent in the second layer; while in a further embodiment the first layer has a quantity of blowing agent that is at least 2.5 times the quantity of blowing agent in the second layer; and in an even further embodiment the first layer has a quantity of blowing agent that is at least 3 times the quantity of blowing agent in the second layer.

In addition to the two layer embodiment just described, a further embodiment includes a third layer, having a third layer thickness, located between the first layer and the second layer. Including a third layer may increase the precision of the manufacturing process. As with the two layer embodiments, the individual layers may be adhered to each other, or joined in the compression molding process. Again, the individual layer thicknesses discussed herein are measured before the actual manufacturing process, thus an uncured thickness. In one embodiment both the first layer thickness and the third layer thickness are less than the second layer thickness; in fact, in a further embodiment both the first layer thickness and the third layer thickness are at least 20% less than the second layer thickness. In an even further embodiment both the first layer thickness and the third layer thickness are at least 50-75% of the second layer thickness. In yet another embodiment the first layer thickness and the third layer thickness are 1.00-1.50 mm and the second layer thickness is 1.25-2.50 mm; while in a further embodiment the first layer thickness and the third layer thickness are 1.25-1.40 mm and the second layer thickness is 1.70-2.25 mm; and in yet another embodiment the first layer thickness and the third layer thickness are 1.30-1.35 mm and the second layer thickness is 1.80-2.00 mm. In one embodiment the third layer has a quantity of blowing agent that is at least twice the quantity of blowing agent in the second layer; while in a further embodiment the third layer has a quantity of blowing agent that is at least 2.5 times the quantity of blowing agent in the second layer; and in an even further embodiment the third layer has a quantity of blowing agent that is at least 3 times the quantity of blowing agent in the second layer.

In another embodiment both the first layer thickness and the second layer thickness are less than the third layer thickness; in fact, in a further embodiment both the first layer thickness and the second layer thickness are at least 20% less than the third layer thickness. In an even further embodiment both the first layer thickness and the second layer thickness are less than half of the maximum third layer thickness. In yet another embodiment the first layer thickness and the second layer thickness are less than 1.50 mm and the third layer thickness is at least 2.00 mm; while in a further embodiment the first layer thickness is less than 20% of the maximum third layer thickness and the first layer thickness is less than 50% of the maximum second layer thickness. In an even further embodiment the first layer thickness is less than 0.50 mm, the second layer thickness is at least 0.75 mm, and the third layer thickness is 1.5-8.0 mm.

Further, in these three layer embodiments the first layer, the second layer, and the third layer may contain different quantities of blowing agent causing them to expand differently during the compression molding curing process. For instance, in one example the first layer and the third layer each have a quantity of blowing agent that is at least twice the quantity of blowing agent in the second layer; while in a further embodiment the first layer and the third layer each have a quantity of blowing agent that is at least 2.5 times the quantity of blowing agent in the second layer; while in an even further embodiment the first layer and the third layer each have a quantity of blowing agent that is at least 3 times the quantity of blowing agent in the second layer; while in yet an even further embodiment the first layer and the third layer each have a quantity of blowing agent that is 3-6 times the quantity of blowing agent in the second layer; and in an even further embodiment the first layer and the third layer each have a quantity of blowing agent that is 4-5.5 times the quantity of blowing agent in the second layer. The blowing agents previously discussed are also applicable to this third layer, as are the material compositions and characteristics of the first layer.

The quantity of blowing agent and the compression molding process parameters affect the density, porosity, and hardness of the regions of the golf grip (10). The golf grip (10) may be compression molded using the layers previously discussed. Strips of the layers are positioned in both halves of the compression mold (M), about a core rod (R), in an arrangement corresponding to that desired in the finished grip. A core rod (CR), or mandrel, is positioned in the half mold to facilitate forming the hollow tubular golf grip (10). The compression half molds are clamped together and heated to a temperature that vulcanizes and joins the layers together into the tubular form of the finished golf grip (10). In some embodiment the core rod (CR) is heated, or warmed, to a temperature of at least 120° C. to also promote curing from the interior surface (120).

Figure 10:
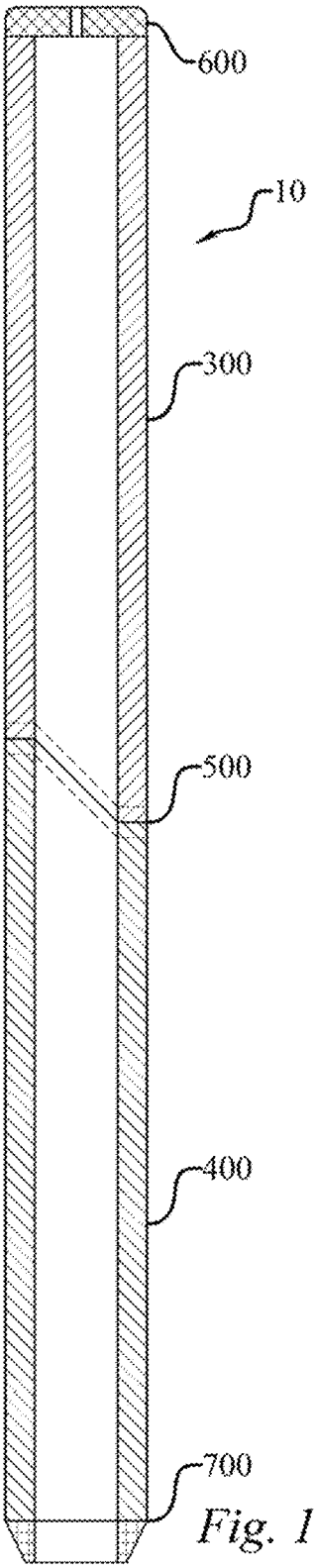
FIG. 10 shows a longitudinal cross-section, taken along section line 10-10 in FIG. 2, of an embodiment of the golf grip, not to scale.
Figure 11:
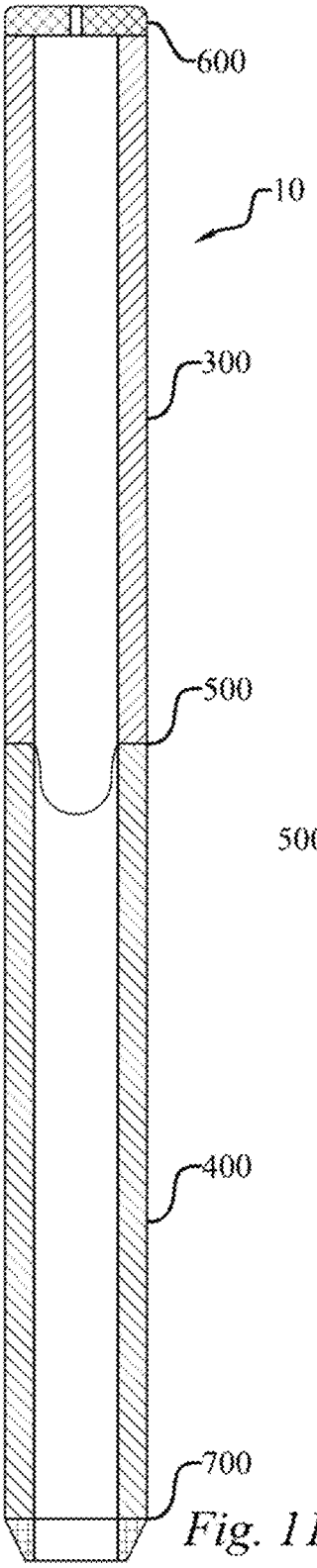
FIG. 11 shows a longitudinal cross-section, taken along section line 11-11 in FIG. 6, of an embodiment of the golf grip, not to scale.

The golf grip (10) embodiments disclosed herein may also include a butt cap (600) and/or a tip cap (700), as seen in FIGS. 10-12. The butt cap (600) or tip cap (700) may also be a different color than the adjacent first section (300) or second section (400), and may be compression molded to be integral with the golf grip (10) or may be separately attached. In one embodiment the butt cap (600) and tip cap (700) are also composed of a thermoset elastomer compound and are compression molded with the golf grip (10). In a further embodiment at least one of the butt cap (600) and tip cap (700) have a lower quantity of blowing agent than that contained in both the first section (300) and the second section (400).

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. Further, the use of exterior surface (110) throughout does not preclude a cosmetic or decorative coating of 1 mm thickness, or less, over the structural exterior surface (110). The corresponding structures, materials, acts, and equivalents of all means or step plus function elements in the claims below are intended to include any structure, material, or acts for performing the functions in combination with other claimed elements as specifically claimed.

We claim:

1. A lightweight compression molded multicolor golf grip, comprising:

an elongated tubular body having an exterior surface, an interior surface, a butt end, a tip end, and a length from the butt end to the tip end wherein each point along the length has a cross-section having a cross-sectional area, an exterior cross-sectional radius, and an interior surface radius;

wherein the elongated tubular body includes a first section having a first color and a first interface edge, and a second section having a second color, different from the first color, and a second interface edge;

wherein the first section and the second section are composed of elastomer compounds having a density of less than 0.90 g/cc and the first section and second section are joined by cross-linking across a sharply defined cross-color interface having an interface transition zone, located within 0.150" of the first interface edge and the second interface edge where they abut, beyond which there is no mixing of the first color and the second color;

wherein the first section is formed of at least one first section preform and the second section is composed of at least one second section preform, the first section preform is composed of a first rubber compound and the second section preform is composed of a second rubber compound, the first section preform has a first preform interface edge and the second section preform has a second preform interface edge, the first preform interface edge abuts the second preform interface edge in a compression mold to produce cross-linking across the interface edges and create the sharply defined cross-color interface, the first section preform has a first preform thickness and the second section preform has a second section thickness, and the first preform thickness of a portion of the first section preform is different than the second preform thickness of a portion of the second section preform;

wherein the first preform interface edge has a first section edge geometry, and the second preform interface edge has a second section edge geometry, wherein the first section edge geometry cooperates with the second section edge geometry; and wherein the portion of the first preform interface edge contacting the second preform interface edge defines a contact area that is at least 15% greater than a baseline contact area.

2. The golf grip of claim 1, wherein the first rubber compound contains a first quantity of a first blowing agent.

3. The golf grip of claim 2, wherein the first section preform has a density of less than 0.90 g/cc and the first quantity of the first blowing agent is at least 1 phr.

4. The golf grip of claim 3, wherein the second rubber compound contains a second quantity of a second blowing agent that is at least 1 phr and the second section preform has a density of less than 0.90 g/cc.

5. The golf grip of claim 4, wherein the first quantity of the first blowing agent is no more than 5 phr and the second quantity of the second blowing agent is no more than 5 phr.

6. The golf grip of claim 1, wherein a portion of the first section edge geometry is an apex geometry and a portion of the second section edge geometry is a cooperating receiver geometry.

7. The golf grip of claim 6, wherein the apex geometry includes two converging sides that approach at an angle of 120 degrees or less.

8. The golf grip of claim 6, wherein the apex geometry has an apex geometry length measured parallel to the longitudinal axis of the golf grip and an apex geometry width measured perpendicularly to the longitudinal axis of the golf grip along the exterior surface, and the apex geometry length is at least 70% of the maximum apex geometry width.

9. The golf grip of claim 1, wherein the first preform interface edge and the second preform interface edge do not overlap each other.

10. The golf grip of claim 9, wherein at least a portion of the first preform interface edge and at least a portion of the second preform interface edge are cut at an angle of 80-89 degrees so that a portion of the abutting interface edges are initially in contact in the compression mold and a portion of the abutting interface edges are initially not in contact in the compression mold.

11. The golf grip of claim 4, wherein the first rubber compound includes an ethylene propylene diene monomer (EPDM) mixture and the first blowing agent is a first expanding blowing agent, the second rubber compound includes an ethylene propylene diene monomer (EPDM) mixture and the second blowing agent is a second expanding blowing agent.

12. The golf grip of claim 1, wherein the density of the completed golf grip within the transition zone is at least 2.5% greater than the overall density of the golf grip.

13. The golf grip of claim 1, wherein the golf grip has a compression ratio of the compressive force to the compression depth that does not exceed 300 N/inch throughout a compression depth range of 0.01" to 0.02".

14. The golf grip of claim 1, wherein the first preform thickness at the first preform interface edge is at least 0.125" and the second preform thickness at the second preform interface edge is at least 0.125".

15. The golf grip of claim 1, wherein a portion of the golf grip has a slope of a compressive force-depth line does not exceed 400 throughout a compression depth range of 0.01" to 0.02".

16. A lightweight compression molded multicolor golf grip, comprising:

an elongated tubular body having an exterior surface, an interior surface, a butt end, a tip end, and a length from the butt end to the tip end wherein each point along the length has a cross-section having a cross-sectional area, an exterior cross-sectional radius, and an interior surface radius;

wherein the elongated tubular body includes a first section having a first color and a second section having a second color different from the first color;

wherein the first section and the second section are composed of thermoset-based elastomer compounds having a density of 0.60-0.90 g/cc and the first section and second section are joined by cross-linking across a sharply defined cross-color interface having an interface transition zone beyond which there is no mixing of the first color and the second color, the first section formed of at least one first section preform and the second section formed of at least one second section preform, wherein the first section preform has a first preform interface edge and the second section preform has a second preform interface edge, the first preform interface edge abutting the second preform interface edge in a compression mold to produce cross-linking across the interface edges and create the sharply defined cross-color interface, and the first section preform has a first preform thickness and the second section preform has a second section thickness, and the first preform thickness of a portion of the first section preform is different than the second preform thickness of a portion of the second section preform, and wherein the first section preform is composed of a first rubber compound and the second section preform is composed of a second rubber compound, the first section preform having a density of less than 0.90 g/cc, and the second section preform has a density of less than 0.90 g/cc;

wherein the interface transition zone is located within 0.150" of the first preform interface edge and the second preform interface edge;

wherein the first preform interface edge has a first section edge geometry, and the second preform interface edge has a second section edge geometry, wherein the first section edge geometry cooperates with the second section edge geometry; and wherein the portion of the first preform interface edge contacting the second preform interface edge defines a contact area that is at least 15% greater than a baseline contact area.

17. The golf grip of claim 16, wherein at least one of the first preform thickness and the second preform thickness at the second preform interface edge is at least 0.125".

18. The golf grip of claim 17, wherein the first rubber compound contains a first quantity of a first blowing agent and the first quantity of the first blowing agent is at least 1 phr.

19. The golf grip of claim 18, wherein the second rubber compound contains a second quantity of a second blowing agent that is at least 1 phr.

20. The golf grip of claim 18, wherein the contact area that is at least 30% greater than a baseline contact area.

* * * * *